US005450110A

United States Patent [19]

Sato et al.

[11] Patent Number: 5,450,110

[45] Date of Patent: Sep. 12, 1995

[54] CONNECTION BETWEEN AN INK JET HEAD AND AN INK SUPPLY MEMBER IN AN INK JET RECORDING APPARATUS

[75] Inventors: Osamu Sato, Kiyose; Haruo Uehara, Yokohama; Yoshifumi Hattori, Yamato; Naohito Asai, Yokohama; Hideo Saikawa, Kawasaki; Tsutomu Abe, Isehara, all of Japan

[73] Assignee: Canon Kabushiki Kaisha, Tokyo, Japan

[21] Appl. No.: 335,973

[22] Filed: Nov. 3, 1994

Related U.S. Application Data

[63] Continuation of Ser. No. 208,191, Mar. 10, 1994, abandoned, which is a continuation of Ser. No. 822,215, Jan. 17, 1992, abandoned.

[30] Foreign Application Priority Data

| | | | |
|---|---|---|---|
| Jan. 18, 1991 | [JP] | Japan | 3-004442 |
| Jan. 18, 1991 | [JP] | Japan | 3-004443 |
| Jan. 18, 1991 | [JP] | Japan | 3-004444 |
| Jan. 18, 1991 | [JP] | Japan | 3-004445 |
| Jan. 18, 1991 | [JP] | Japan | 3-004708 |

[51] Int. Cl.[6] ..... B41J 2/05

[52] U.S. Cl. ..... 347/67; 347/63; 347/65

[58] Field of Search ..... 347/63, 65, 66, 67

[56] References Cited

U.S. PATENT DOCUMENTS

| | | | |
|---|---|---|---|
| 4,313,124 | 1/1982 | Hara | 346/140 R |
| 4,345,362 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,509,063 | 4/1985 | Sugitani et al. | 346/140 R |
| 4,558,333 | 12/1985 | Sugitani et al. | 346/140 R |
| 4,628,332 | 12/1986 | Matsumoto . | |
| 4,698,645 | 10/1987 | Inamoto | 346/140 R |
| 4,723,129 | 2/1988 | Endo et al. | 346/1.1 |
| 4,740,796 | 4/1988 | Endo et al. | 346/1.1 |
| 4,967,207 | 10/1990 | Ruder | 346/140 R |
| 5,017,947 | 5/1991 | Masuda | 346/140 R |
| 5,095,321 | 3/1992 | Saito et al. | 346/140 R |
| 5,155,502 | 10/1992 | Kimura et al. | 346/140 R |

FOREIGN PATENT DOCUMENTS

| | | |
|---|---|---|
| 3511381 | 10/1985 | Germany . |
| 55-003961 | 1/1980 | Japan . |
| 57-116680 | 7/1982 | Japan . |
| 58-181656 | 10/1983 | Japan . |
| 59-123670 | 7/1984 | Japan . |
| 59-138461 | 8/1984 | Japan . |
| 60-085962 | 5/1985 | Japan . |
| 60-232965 | 11/1985 | Japan . |
| 61-035958 | 2/1986 | Japan . |
| 62-152757 | 7/1987 | Japan . |
| 62-208947 | 9/1987 | Japan . |
| 63-037954 | 2/1988 | Japan . |
| 63-154355 | 6/1988 | Japan . |
| 2-121841 | 5/1990 | Japan . |
| 2204044 | 8/1990 | Japan . |
| 3169557 | 7/1991 | Japan . |

*Primary Examiner*—A. T. Grimley
*Assistant Examiner*—Sandra L. Brase
*Attorney, Agent, or Firm*—Fitzpatrick, Cella, Harper & Scinto

[57] ABSTRACT

An ink jet recording head unit for performing a recording operation by discharging ink is desclosed. The ink jet recording head unit includes an ink jet head portion having an ink passage communicated with a discharge port for discharging ink and a substrate having an energy generating element for causing energy for discharging ink to act on ink present in the ink passage, the ink being supplied through an ink receiving port of a connecting portion; and an ink supply member having a connecting portion to be connected to the ink jet head portion so as to supply ink to the ink jet head portion via the connecting portion. At least one of the connecting portion of the ink jet head portion and the connecting portion of the ink supply member has a projection portion at a position at which it comes in contact with the corresponding connection port so that one connecting portion is respectively connected to a corresponding connecting portion by deforming and bringing the projection portion into contact with the connecting portions.

69 Claims, 13 Drawing Sheets

CONNECTION BETWEEN AN INK JET HEAD AND AN INK SUPPLY MEMBER IN AN INK JET RECORDING APPARATUS

This application is a continuation of application Ser. No. 08/208,191 filed Mar. 10, 1994, which was a continuation of application Ser. No. 07/822,215 filed Jan. 17, 1992, both now abandoned.

BACKGROUND OF THE INVENTION

1. Field of the Invention

The present invention relates to an ink jet head unit for recording information by droplets discharged from a discharging port, an ink jet head cartridge having the above-described unit and an ink jet recording apparatus having the above-described head cartridge.

More particularly, the present invention relates to an ink jet head unit, an ink jet head cartridge and an ink jet recording apparatus having a portion through which ink passes and a junction of the ink supply passage exhibiting improved sealing performance and air tightness performance.

2. Related Background Art

In order to perform a recording operation as desired in accordance with the ink jet recording method in which ink is discharged from a discharging port, air tightness must be satisfactorily secured in an ink passage and an ink supply passage.

As shown in FIG. 15, an example of an ink jet head (hereinafter sometimes called an "IJH") for use in the ink jet recording method comprises a substrate 1 (hereinafter called a "heater board") on which an ink discharging pressure generating device is formed, a liquid chamber 7 connected to the substrate 1 and accommodating a recording liquid (hereinafter called "ink") and a substrate 2 having a recessed portion which constitutes an ink passage 8. The above-described substrate 2 integrally has an orifice plate 4 (hereinafter called a "grooved ceiling plate") which has ink discharge port 9 communicated with the ink passage 8 and acting to discharge ink.

The heater board 1 is allowed to adhere to a supporting substrate 3 by an adhesive agent, while the grooved ceiling plate 2 is allowed to adhere to the surface of the heater board 1 in such a manner that a heater portion disposed on the heater board 1 and serving as an ink discharging pressure generating device coincides with the ink passage 8 formed in the grooved ceiling plate 2. Furthermore, the orifice plate 4, which is the grooved ceiling plate, is disposed on the front surface of the supporting substrate 3 in such a manner that it is downwardly hung.

Ink is supplied from an ink supply member 5 after it has passed through an ink supply port 2*a* formed in the upper portion of the grooved ceiling plate. The ink supply member 5 has a projection rod which is inserted into a through hole formed in the supporting substrate before they are caulked by heat so that the ink supply member 5 is secured to the supporting substrate.

It is necessary for an ink jet head unit of the above-described type in which the IJH is constituted by bringing the first substrate, on which the energy generating device is formed, and the second substrate having a groove, which forms the ink passage through which recording liquid passes through, into contact with each other in a hermetical manner by mechanical urging force to be arranged in such a manner that the first substrate and the second substrate are brought perfectly into contact with each other so as to be hermetically sealed from outside air. If the above-described air tightness is not realized satisfactorily, there arises a problem in that normal liquid discharge cannot be performed because ink placed in the IJH leaks outside or the pressure generated at the time of discharging the liquid droplet leaks through the ink passage or the like. However, it is extremely difficult to bring the above-described two substrates perfectly into contact with each other due to a limitation present at the time of reducing cost or the overall size because it is necessary for the accuracy of each element to be extremely improved and the mechanical urging force to be extremely enlarged.

The above-described air tightness must, of course, be sufficiently maintained even if pressure for discharging ink is repeatedly applied.

Furthermore, there is a necessity of sucking ink placed in the IJH by a cap member to be described later in a case where liquid cannot normally be discharged, for example, after the ink jet unit has been allowed to stand for a long time. Therefore, air tightness must be realized not only in the IJH but also the peripheral portion of the IJH.

As a method of improving the air tightness in the vicinity of the IJH, a structure has been disclosed in Japanese Laid-Open Patent Application No. 2-121841 which is arranged in such a manner that a silicon sealer is introduced into small gaps 10*a* and 10*b* between the ink supply member 5, the heater board 1 and the grooved ceiling plate 2 and the like. Furthermore, the same is introduced into an adhesive space in the connecting region to which the adhesive is introduced and which has small gaps formed between the orifice plate and the front surface of the supporting substrate.

Furthermore, the above-described sealer acts to seal a connecting portion 10*c* for establishing a connection between the heater board 1 and the grooved ceiling plate. The same also acts to seal the connecting portion of the ink supply member 5 and the connecting portion 10*d* to be connected to the ink supply port 2*a* which is the connecting portion with the ink jet head. However, it is not used in a case where the ink supply member 5 and the grooved ceiling plate 2 are integrally formed. That is, the sealer is used as follows:

(1) It acts to uniformly seal a very small gap formed in a connecting region positioned between the orifice plate 4 and the front surface of the supporting substrate 3 and the gaps 10*a* and 10*b* formed between a head chip constituted by the heater board 1, the supporting substrate 3 and the groove ceiling plate 2 and the ink supply member 5. As a result, it forms and remains a sealed space which is sufficiently large to perform the recovery operation by sucking in order to overcome a problem of non-discharge from the ink discharge port 9 due to blinding caused from solidification of dried ink or bubbles mixed into the ink passage 8 or the like.

(2) It is used to seal the connecting portion 10*c* between the heater board and the grooved ceiling plate 2 and the connecting portion 10*d* formed between the ink supply member 5 and the ink supply port 2*a*.

Furthermore, the sealer also acts to protect the wire bonding portion for electrically connecting the printed circuit board and the IJH from mechanical force generated due to impact or drop or moisture, the printed circuit board serving as a wiring portion for supplying electric energy with which the IJH is caused to discharge liquid.

On the other hand, the structure of the connecting portion (10*d*) of the ink supply passage for supplying ink to the IJH is arranged in such a manner that the force is applied to the connecting surface between the ink supply member 5 and the ink supply port 2*a* to improve the adhesion. Furthermore, the silicone resin sealer is used to improve the air tightness.

As an example of the above-described structure, a structure is employed in which the ink supply port of the IJH and the conducting pipe of the ink supply passage for supplying ink are brought into contact with each other in such a manner that the free end portion of the conducting pipe of the cantilever type is brought into contact with the ink supply port before the overall body is warped. As described above, force generated by deforming the members positioned adjacent to the connecting portion is usually utilized.

However, in the above-described case in which the members are warped, there arises a risk of breakage of the member if the members are warped excessively. Therefore, the above-described member such as the conducting pipe must have a predetermined length or longer. As a result, there arises a problem in that the size of the ink supply passage member including the conducting pipe formed into the above-described structure cannot be reduced.

In addition, since the connections of the members such as the conducting pipe and the ink receiving port brought into contact with each other are established by utilizing the warp or the like of the members, it is difficult to hermetically connect them. Furthermore, the sealer for sealing the members is undesirably introduced into the connecting portions or the ink can be allowed to leak due to the insufficient result of the sealing operation.

On the other hand, the silicon resin is used as the sealer to be injected into the above-described IJH portion and the connecting portion of the above-described supply passage. However, since the silicon resin displays a high gas permeability of $400\times10^{-10}$ [$cm^3$][cm]/[sec][$cm^2$][cmHg] with respect to air, it is undesirably introduced into the IJH in a relatively short time in an atmospheric condition of low humidity. Therefore, the normal ink discharge cannot be performed, and, worst of all, the ink passage is blocked by bubbles formed by introduced air, causing a problem to be taken place in that the ink discharge cannot be performed.

Furthermore, since it well displays a high steam permeability of $4\times10^{-6}$ [$cm^3$][cm]/[sec][$cm^2$][cmHg], ink which is placed at the front end portion of the nozzle and the main component of which is water can undesirably evaporated in a relatively short time. Therefore, the density of ink is raised and thereby the normal ink discharge is inhibited and, worst of all, ink discharge cannot be performed.

The above-described phenomenon shows a tendency in that it apparently arises in a state of high temperature or a state of low temperature. In order to overcome the above-described problem, a structure has been employed which is arranged in such a manner that the adhesion between the capping and the head is improved. Another structure is employed which is arranged in such a manner that material displaying a low steam permeability is employed as the material for the capping member. However, although a certain effect is obtained from the above-described structures, the degree of it has not been satisfactory. Therefore, a manual or an automatic recovery operation by means of sucking or a previous discharge for purging must be performed. In a case of the manual recovery operation, a problem takes place in that a user must frequently perform the recovery operations. In a case of the automatic recovery operation, another problem takes place in that a timer or the like for performing the automatic ink sucking sequence must be provided for the body of the printer. In addition, since the silicon resin displays a high gas permeability with respect to oxygen and nitrogen, air is undesirably introduced into the IJH in a short time and thereby the normal ink discharge operation cannot be performed. In an extreme case, the ink passage is blocked by bubbles formed by introduced air, causing the problem to be taken place in that the ink discharge cannot be performed. Therefore, the ink sucking operation must frequently be performed as the recovery operation.

The above-described deterioration in the ink due to the undesirable introduction of air or the evaporation of the solvent of the ink becomes critical in an ink jet head unit which uses an electrothermal converting material. The reason for this lies in that the change in the ink composition considerably affects the generation of the bubbles at the time of performing the ink discharge by generating the bubbles with heat.

The above-described problem becomes critical in a case of the IJH of the type arranged in such a manner that the two substrates are connected to each other by the mechanical urging force to form the ink passage and the common liquid chamber because the gap cannot completely be eliminated.

The above-described recovery operation performed frequently will decrease the number of sheets which can be printed for one cartridge because ink used for the above-described recovery operation is rejected as waste ink and the same is not used in the printing operation. As a result, the running cost cannot be reduced. Furthermore, since there arises a necessity of forming a space for accommodating the waste ink, the overall size of the printer must be enlarged by a degree corresponding to the above-described required space. The above-described becomes critical in an ink jet cartridge of a type which has the ink jet unit and the ink tank formed integrally because there is a desire to minimize the capacity of the ink tank and the overall size of the printer.

On the other hand, in a case where the material displaying low gas-permeability and a low steam permeability is used as the sealer, it corrodes the aluminum electrode or the aluminum wire bonding portion. Therefore, the above-described material cannot be used in a case where there is a risk of disconnection. That is, since aluminum is ampholytic metal, it can be corroded by acid and alkali. For example, aluminum can react on amines contained in an epoxy adhesive agent, peroxides contained in an acrylic adhesive agent, chlorine ion ($Cl^-$), sodium ion ($Na^+$) and potassium ion ($K^+$) and the like.

Furthermore, the above-described sealer for use in the wire bonding portion and the portion around the IJH, as a member for covering the IJH, must have an excellent adhesive performance with a substrate made of polysulfone, polyphenylene oxide (PPO), aluminum or silicon. In addition, the sealer must protect the wire bonding portion from impact, vibrations or atmospheric change such as the temperature or moisture change.

Therefore, it must be an elastomer displaying moisture resistance.

SUMMARY OF THE INVENTION

An object of the present invention is to provide an ink jet head unit, an ink jet head cartridge and an ink jet recording apparatus capable of normally discharging ink while preventing evaporation of ink from the recording head portion and undesirable introduction of bubbles into the recording head even if they are allowed to stand for a long time.

Another object of the present invention is to provide an ink jet head unit, an ink jet head cartridge and an ink jet recording apparatus capable of reducing the size of the ink supply passage member and simplifying the structure of the same and as well as enabling ink to be supplied stably.

Another object of the present invention is to provide an ink jet head unit, an ink jet head cartridge and an ink jet recording apparatus which are suitably manufactured by a mass production manner and the cost of each of which can be reduced because the reliability of the adhesion and sealed portion can be improved and the time take to complete manufacturing can be shortened.

In order to achieve the above-described objects, according to one aspect of the present invention, there is provided an ink jet recording head unit for performing a recording operation by discharging ink, the ink jet recording head unit comprising: an ink jet head portion having an ink passage communicated with a discharge port for discharging ink and a substrate having an energy generating element for causing energy for discharging ink to act on ink present in the ink passage and supplied through an ink receiving port formed in a connecting portion; and an ink supply member having a connecting portion to be connected to the ink jet head portion so as to supply ink to the ink jet head portion via the connecting portion, wherein at least one of the connecting portion of the ink jet head portion and the connecting portion of the ink supply member has a projection portion at a position at which it comes in contact with the corresponding connection port so that the connecting portions are respectively connected to the corresponding connecting portions by deforming and bringing the projection portions to come in contact with the connecting portions.

In this state, it is preferable that the projection portion is formed integrally with the connecting portion.

Furthermore, it is preferable that the connecting portion having the projection portion is made of a resin.

Furthermore, it is preferable that the connecting portion is sealed by a sealer.

Furthermore, it is preferable that the energy generating element is an electro-thermal converting member for generating thermal energy to discharge ink by generating bubbles by the thermal energy.

Furthermore, it is preferable that the sealer is a material having a urethane bond in the molecule.

Furthermore, it is preferable that the sealer is made of material the air permeability of which is $40\times10^{-10}$ [$cm^3$][cm]/[sec][$cm^2$][cmHg] or less.

Furthermore, it is preferable that the sealer is made of material the steam permeability of which is $5\times10^{-7}$ [$cm^3$][cm]/[sec][$cm^2$][cmHg] or less.

According to another aspect of the present invention, there is provided an ink jet head cartridge unit for performing a recording operation by discharging ink, the ink jet recording head unit comprising: an ink jet head portion having an ink passage communicated with a discharge port for discharging ink and a substrate having an energy generating element for causing energy for discharging ink to act on ink present in the ink passage and supplied through an ink receiving port formed in a connecting portion; an ink supply member having a connecting portion to be connected to the ink jet head portion so as to supply ink to the ink jet head portion via the connecting portion; an ink jet head unit arranged in such a manner that at least one of the connecting portion of the ink jet head portion and the connecting portion of the ink supply member has a projection portion at a position at which it comes in contact with the corresponding connection port so that the connecting portions are respectively connected to the corresponding connecting portions by deforming and bringing the projection portion to come in contact with the connecting portions; and an ink tank for supplying ink to the ink jet unit.

In this state, it is preferable that the projection portion is formed integrally with the connecting portion.

Furthermore, it is preferable that the connecting portion having the projection portion is made of a resin.

Furthermore, it is preferable that the connecting portion is sealed by a sealer.

Furthermore, it is preferable that the energy generating element is an electro-thermal converting member for generating thermal energy to discharge ink by generating bubbles by the thermal energy.

Furthermore, it is preferable that the sealer is a material having a urethane bond in the molecule.

Furthermore, it is preferable that the sealer is made of material the air permeability of which is $40\times10^{-10}$ [$cm^3$][cm]/[sec][$cm^2$][cmHg] or less.

Furthermore, it is preferable that the sealer is made of material the steam permeability of which is $5\times10^{-7}$ [$cm^3$][cm]/[sec][$cm^2$][cmHg] or less.

According to another aspect of the present invention, there is provided an ink jet recording apparatus for performing a recording operation by discharging ink, the ink jet recording apparatus comprising: an ink jet head unit including an ink jet head portion having an ink passage communicated with a discharge port for discharging ink and a substrate having an energy generating element for causing energy for discharging ink to act on ink present in the ink passage and supplied through an ink receiving port formed in a connecting portion; and an ink supply member having a connecting portion to be connected to the ink jet head portion so as to supply ink to the ink jet head portion via the connecting portion, wherein at least one of the connecting portion of the ink jet head portion and the connecting portion of the ink supply member has a projection portion at a position at which it comes in contact with the corresponding connection port so that the connecting portions are respectively connected to the corresponding connecting portion by deforming and bringing the projection portions to come in contact with the connecting portions; and a control portion for supplying a drive signal for driving the ink jet head unit.

According to another aspect of the present invention, there is provided an ink jet head unit for performing a recording operation by discharging ink, the ink jet head unit being a recording head comprising: an ink jet head portion having an ink passage communicated with a discharge port for discharging ink and a substrate having an energy generating element for causing energy for discharging ink to act on ink present in the ink passage;

and an ink supply member connected to the ink jet head portion so as to supply ink to the ink jet head portion via the connecting portion, wherein at least a portion of the ink jet head portion and at least of a portion of the ink supply portion are sealed by a sealer made of material the air permeability of which is $40\times10^{-10}$ [$cm^3$][cm]/[sec][$cm^2$][cmHg] or less.

In this state, it is preferable that the energy generating element is an electro-thermal converting member for generating thermal energy to discharge ink by generating bubbles by the thermal energy.

Furthermore, it is preferable that the sealer is a material having a urethane bond in the molecule.

Furthermore, it is preferable that the sealer contains impurities by a density of 30 ppm or less.

Furthermore, it is preferable that the ink jet head portion is composed of the first substrate having the energy generating element, a second substrate having a wall connected to the first substrate and constituting the ink passage and an urging member for giving urging force to the first and second substrates to bring the two substrates into contact with each other.

According to another aspect of the present invention, there is provided an ink jet head unit for performing a recording operation by discharging ink, the ink jet head unit being a recording head comprising: an ink jet head portion having an ink passage communicated with a discharge port for discharging ink and a substrate having an energy generating element for causing energy for discharging ink to act on ink present in the ink passage; an ink supply member connected to the ink jet head portion so as to supply ink to the ink jet head portion via the connecting portion, wherein at least a portion of the ink jet head portion and at least a portion of the ink supply portion are sealed by a sealer made of material the steam permeability of which is $5\times10^{-7}$ [$cm^3$][cm]/[sec][$cm^2$][cmHg] or less.

In this state, it is preferable that the energy generating element is an electro-thermal converting member for generating thermal energy to discharge ink by generating bubbles by the thermal energy.

Furthermore, it is preferable that the sealer is a material having a urethane bond in the molecule.

Furthermore, it is preferable that the ink jet head portion is composed of the first substrate having the energy generating element, a second substrate having a wall connected to the first substrate and constituting the ink passage and an urging member for giving urging force to the first and second substrates to bring the two substrates to into contact with each other.

Furthermore, it is preferable that the sealer contains impurities by a density of 30 ppm or less.

According to another aspect of the present invention, there is provided an ink jet head unit for performing a recording operation by discharging ink, the ink jet head unit being a recording head comprising: an ink jet head portion having an ink passage communicated with a discharge port for discharging ink and a substrate having an energy generating element for causing energy for discharging ink to act on ink present in the ink passage; and an ink supply member connected to the ink jet head portion so as to supply ink to the ink jet head portion via the connecting portion, wherein at least a portion of the ink jet head portion and at least a portion of the ink supply portion are sealed by a photosetting resin.

In this state, it is preferable that the ink jet head portion is composed of the first substrate having the energy generating element, a second substrate having a wall connected to the first substrate and constituting the ink passage and an urging member for giving urging force to the first and second substrates to bring the two substrates to into contact with each other.

Other and further objects, features and advantages of the invention will be appear more fully from the following description.

DETAILED DESCRIPTION OF THE PREFERRED EMBODIMENTS

Preferred embodiments of the present invention will now be described with reference to the drawings.

FIGS. 16 to 19 illustrate an ink jet head unit IJU, an ink jet head IJH, an ink tank IT, an ink jet head cartridge IJC according to the present invention. A description will be made about elements with reference to the drawings.

Figure 16:
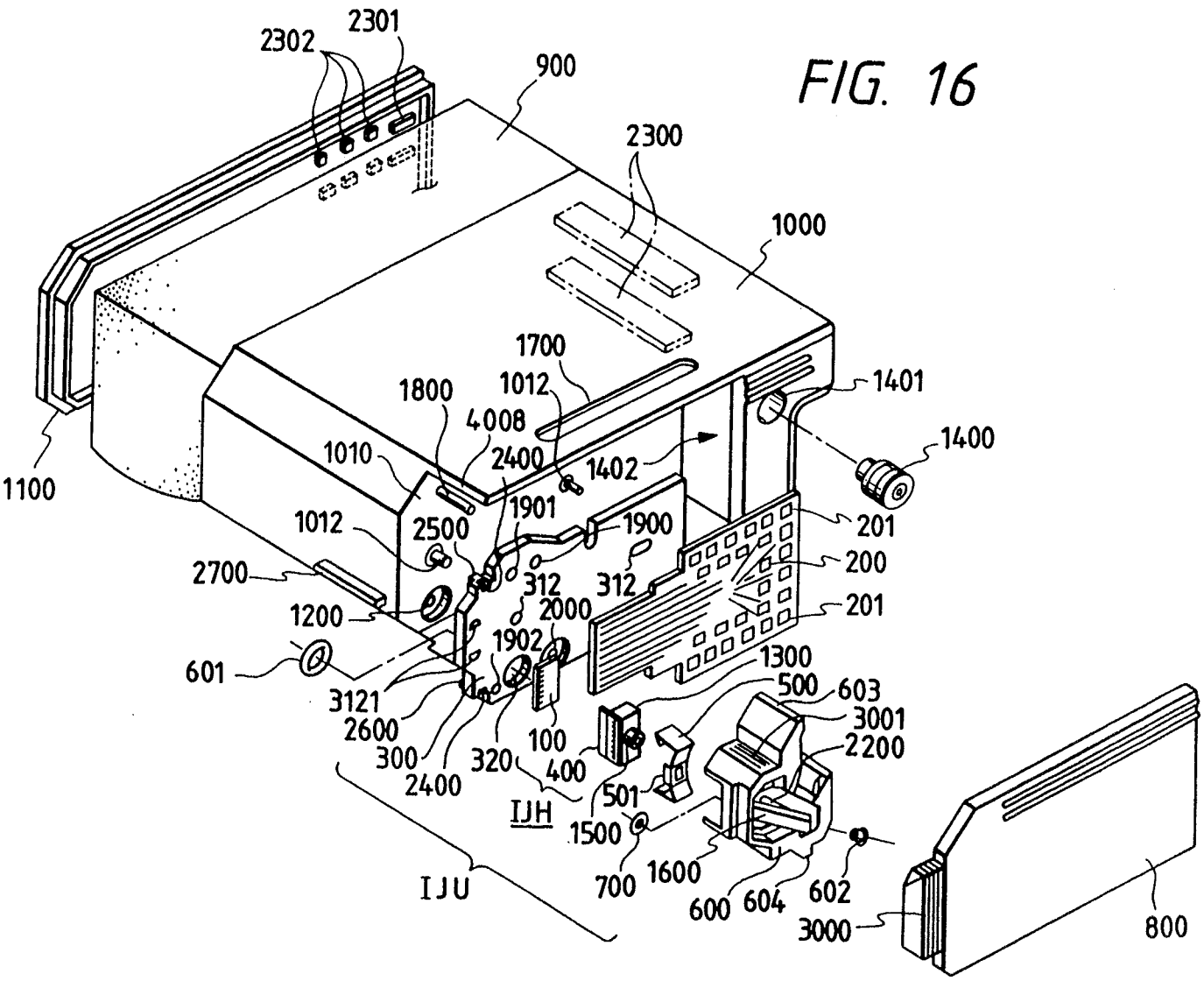
FIG. 16 is an exploded perspective view which illustrates an example of the ink jet cartridge according to the present invention.
Figure 17:
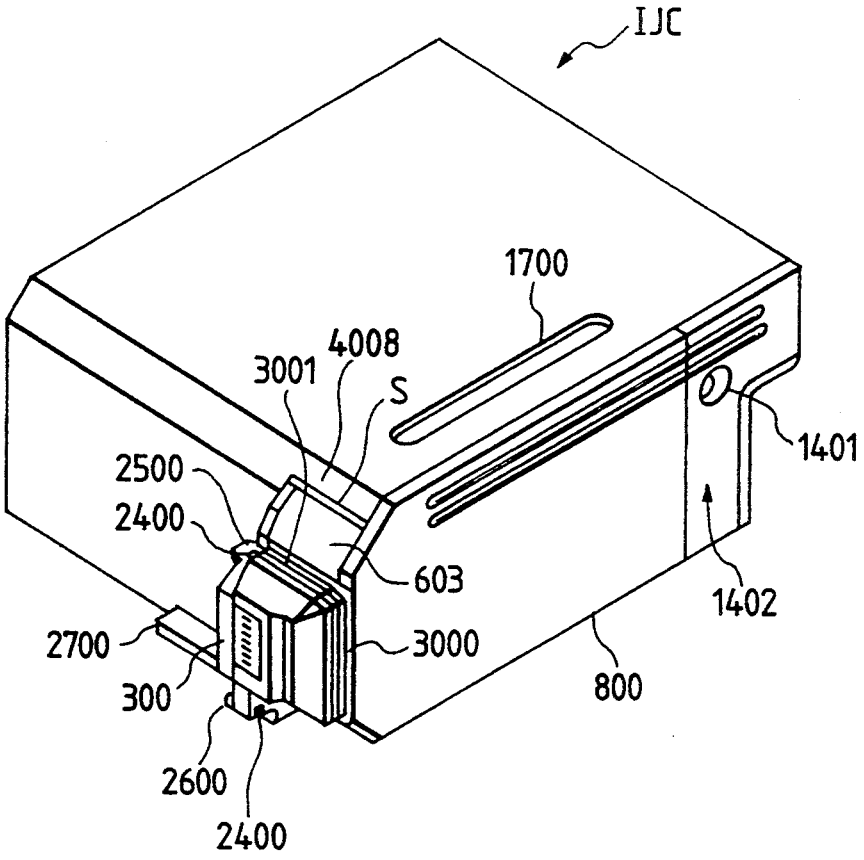
FIG. 17 is a schematic perspective view which illustrates an ink jet cartridge according to the present invention.

The ink jet cartridge IJC according to this embodiment is arranged in such a manner that the proportion the portion for accommodating ink is enlarged as can be understood from a perspective drawing shown in FIG. 17. Therefore, the shape is made such that the front end portion of the ink jet head unit IJU projects over the front surface of the ink tank IT by a certain small degree. The above-described ink jet head cartridge IJC is secured and supported by a locating means to be described later and an electric contact of a carriage HC (18) mounted on an ink jet recording apparatus body IJRA. In addition, the same is formed into a disposable type such that it can be attached/detached from the above-described carriage HC. Since FIGS. 16 to 19 illustrate the structure to which a plurality of novel technologies found during the establishment of the present invention are applied, the overall structure of the present invention will now be described while briefly describing the above-described structures.

(i) Structure of Ink Jet Head Unit IJU

The ink jet head unit IJU is a unit for performing recording by using an electrothermal converting member for, in response to an electric signal, generating thermal energy with which ink is film-boiled.

Referring to FIG. 16, reference numeral 100 represents a heater board constituted in such a manner that electrothermal converting members (a discharging heater) formed into a plurality of lines and electric circuits such as Al for supplying electric power are formed on an Si substrate by a film forming technique. Reference numeral 200 represents a circuit board which corresponds to the heater board 100, the circuit board 200 having a circuit (it is connected by, for example, a wire bonding) which corresponds to the circuit of the heater board 100 and a pad 201 disposed at the end portion of the above-described circuit and acts to receive an electric signal supplied from the body of the apparatus.

Reference numeral 1300 represents a grooved ceiling plate on which insulating walls for sectioning a plurality of ink passage and common liquid chamber for accommodating ink to be supplied to each ink passage and the like are formed. The grooved ceiling 1300 is manufactured by integrally forming an ink receiving port 1500 for receiving ink supplied from the ink tank IT to introduce it into the above-described common liquid chamber and an orifice plate having a plurality of discharge ports which corresponds to the ink passages. As the material for the integrally formed member, it is preferable that polysulfone be employed. However, another molding resin may be employed.

Figure 19:
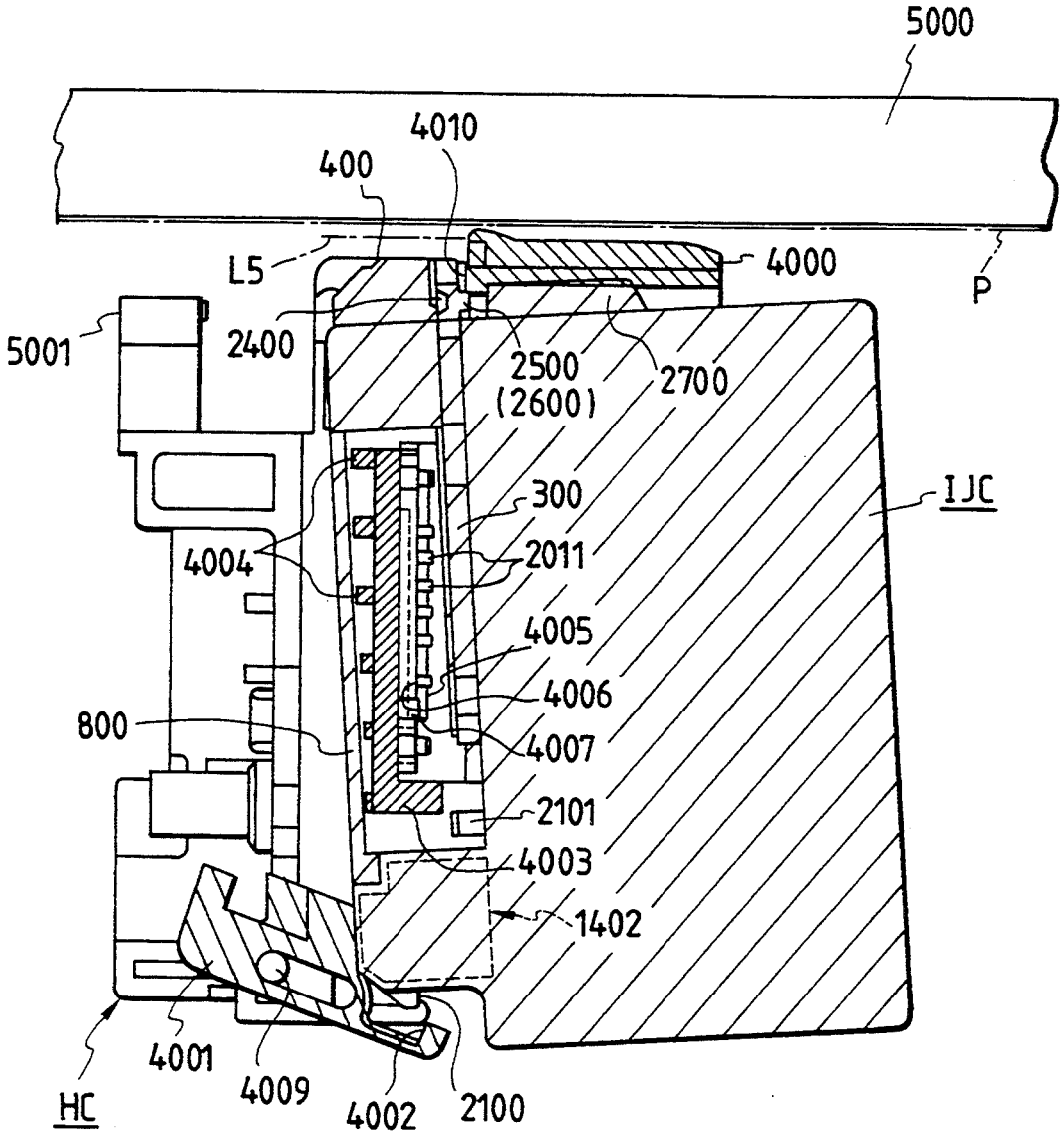
FIG. 19 is a top view which illustrates a state in which the ink jet cartridge apparatus body is fastened to the carriage.

Reference numeral 300 represents a supporting member made of, for example, metal and acting to support the reverse side of the circuit board 200 by the plane thereof, the supporting member 300 being made to be bottom plate of the ink jet head unit. Reference numeral 500 represents a retaining spring formed into an M-shape so as to press the common liquid chamber at the central portion of the M-shape retaining spring with a light pressure. Furthermore, the retaining spring 500 concentrically presses a portion of the liquid passage by its front hung portion 501, preferably it presses the region adjacent to the discharge port with linear pressure. The heater board 100 and the ceiling plate 1300 are fastened to each other in such a manner that the leg portion of the retaining spring passes through a hole 3121 formed in the supporting member 300 to be fastened to the reverse side of the supporting member 300. As a result, the heater board 100 and the ceiling plate 1300 are pressed and secured to each other by concentrated urging force of the retaining spring 500 and its front hung portion 501. Furthermore, the supporting member 300 comprises locating holes 312, 1900 and 2000 to be engaged to projections 1012 for locating the ink tank IT and locating/fusion-remaining projections 1800 and 1801. Furthermore, it comprises, on the reverse side thereof, projections 2500 and 2600 for locating the carriage HC of the apparatus body IJRA. In addition, the supporting member 300 has a hole 320 through which an ink supply pipe 2200 (to be described later) which enables ink to be supplied from the ink tank passes. The circuit board 200 is fastened to the supporting member 300 by adhesion or the like. The supporting member 300 has recessed portions 2400 formed adjacent to the locating projections 2500 and 2600. In a state in which the ink jet head cartridge IJC (see FIG. 17) are built up, the recessed portions 2400 are formed on extension points at the front end portions of the head the three sides of which are formed by parallel grooves 3000 and 3001. As a result, unnecessary substance such as dust or ink or the like do not reach the projections 2500 and 2600. A cover member 800 in which the above-described parallel groove 3000 is formed is, as shown in FIG. 19, forms an outer wall of the ink jet head cartridge IJC and as well forms a space in which the ink jet head unit IJU is accommodated in association with the ink tank. An ink supply member 600 in which the parallel groove 3001 is formed is arranged in such manner that an ink conducting pipe 1600 to be connected to the above-described ink supply pipe 220 is formed while making the portion adjacent to the supply pipe 2200 to be a fixed cantilever. In addition, a sealing pin 602 is inserted for the purpose of maintaining the capillary between the fixed side of the ink conducting pipe and the ink supply pipe 2200. Reference numeral 610 represents a packing for establishing a sealed state between the ink tank IT and the supply pipe 2200. Reference numeral 700 represents a filter disposed at an end portion of the supply pipe adjacent to the tank.

Since the above-described ink supply member 600 is manufactured by molding, a satisfactory accuracy can be realized while reducing the cost and the deterioration in the accuracy during the forming process can be prevented. In addition, since the cantilever type conducting pipe 1600 is employed, the state of contact of the conducting pipe 1600 with the above-described ink receiving port 1500 can be stabilized even if a mass-production method is employed. According to this embodiment, simply by introducing the sealing adhesive agent from the ink supply member, a further perfect communication state can reliably be realized. The ink supply member 600 can easily be secured to the supporting member 300 in such a manner that reverse side pins (omitted from illustration) of the ink supply member 600 with respect to the holes 1901 and 1902 formed in the supporting member 300 are projected through the holes 1901 and 1902 and as well the portions projecting over the surface of the reverse side of the supporting member 300 are welded by heat. The small projection regions on the reverse portion welded by heat can be accommodated in a recessed portion (omitted from illustration) formed on the wall surface of the ink tank IT which is fastened to the ink jet head unit IJU. Therefore, the unit IJU can be accurately located.

(ii) Structure of Ink Tank IT

The ink tank comprises a cartridge body 1000, an ink absorbing member group 900 to be described later and cover member 1100 for sealing the ink absorbing member group 900 after it has been inserted into a side surface of the cartridge body 1000 opposing the surface of the cartridge body 1000 which is fastened to the above-described unit IJU.

Reference numeral 900 represents the absorbing member group for impregnating ink and disposed in the cartridge body 1000. Reference numeral 1200 represents a supply port for supplying ink to the unit IJU composed of the above-described elements 100 to 600.

According to this embodiment, ink can be supplied through a port communicated with atmospheric air and the above-described supply port. However, it is important for the ink supply to relatively satisfactorily and uniformly be performed from the ink absorbing member that ink is supplied to the absorbing member through the supply port 1200 because a structure is employed which is arranged in such a manner that an air-present region in the tank and formed by a rib 2300 in the body 1000 and partial ribs 2400 and 2500 of the cover member 100 is continuously formed from the portion adjacent to the atmospheric air communication port 1401 to a corner portion distance farther from the ink supply port 1200. The above-described method is extremely effective in view of practical use. The above-described rib 2300 has, on the rear surface of the body 1000 of the ink tank, four parallel ribs in a direction in which the carriage is moved so that adhesion of the absorbing member to the rear surface is prevented. Furthermore, the partial ribs 2400 and 2500 are formed on the inner surface of the cover member 1100 present on the extension line which corresponds to the rib 2300. However, each of the partial ribs 2400 and 2500 is sectioned into pieces in a manner different from the rib 2300. Therefore, the space, in which air is able to be present, can be enlarged in comparison to that realized by the above-described rib 2300. The partial ribs 2500 and 2400 are dispersedly formed on a plane which is smaller than the half area of the entire surface of the cover member 1100. As a result, the ink present in the corner region farther from the tank supply port 1200 of the ink absorbing member can stably and reliably be introduced toward the supply port 1200 by capillary. Reference numeral 1401 represents the atmospheric air communication port formed in the cover member for establishing a communication between the inside portion of the cartridge and the atmospheric air. Reference numeral 1400 represents liquid repellent material disposed in the atmospheric air communication port 1401 so that ink leakage from the atmospheric air communication port 1401 can be prevented.

The above-described ink accommodating space in the ink tank IT is formed into a rectangular shape arranged in such a manner that its longer side is arranged to be the side surface. Therefore, an excellent effect can be obtained from the above-described rib configuration. In a case where its longer side is arranged to be present in the direction in which the carriage is moved or in a case of a cubic ink tank accommodating space, it is necessary to form a rib on the overall body of the cover member 1100 so that the ink supply can be stabled. In order to accommodate ink by a larger quantity in a limited space, it is preferable that it is formed into a rectangular parallelopiped. Furthermore, in order to efficiently use the ink thus accommodated in the recording operation, it is important to provide ribs capable of performing the above-described operation for the two side regions adjacent to the corner region. In addition, the inside ribs of the ink tank IT according to this embodiment are substantially uniformly distributed in the direction of the thickness of the rectangular parallelopiped ink absorbing member. The above-described structure is an essential factor to make the atmospheric pressure distribution to be uniform with respect to the total ink consumption in the absorbing member and thereby the residual quantity of the ink can substantially be eliminated. Then, the technological idea about the distribution of the ribs made as described above will now be described. When a circular arc, the radius of which is made to be the longer side of the upper quadrangle surface of the rectangular parallelopiped, is drawn while making the position to which the ink supply port 1200 of the ink tank is projected to be a center, it is important that the above-described ribs are disposed on the surface positioned outside the above-described circular arc in order to quickly give the atmospheric pressure status to the absorbing member disposed outside the above-described circular arc. In this case, the position of the atmospheric air communication port formed in the tank is not limited to that arranged according to this embodiment if it is formed at a position which enables atmospheric air to be introduced into the region in which the ribs are disposed.

In addition, the rear surface of the ink jet head cartridge IJC confronting the head is flattened so as to minimize the space required when it is mounted on the apparatus. Furthermore, the structure is arranged in such a manner that the capacity of ink can be enlarged as much as possible. Therefore, excellent effects can be obtained in that the size of the apparatus can be reduced as well as the required number of times of interchanging the cartridge can be reduced. Furthermore, the rear portion of the space formed for the purpose of integrating the ink jet head unit IJU is utilized to form a projection portion for the atmospheric communicating port 1401. In addition, the inner portion of the above-described projection portion is formed into a hollow shape so as to form therein the atmospheric pressure supply space 1402 which corresponds to the overall thickness of the above-described absorbing member 900. As a result of the thus-arranged structure, an excellent cartridge in comparison to the conventional cartridge can be manufactured. Since the atmospheric pressure supply space 1402 has a considerably larger size in comparison to the conventional space and as well the atmospheric air communicating port 1401 is disposed in the upper portion, the atmospheric pressure supply space 1402 is able to temporarily hold ink even if ink is removed from the absorbing member. Therefore, ink can reliably be recovered by the absorbing member so that an excellent cartridge in which ink can efficiently be used can be provided.

Figure 6:
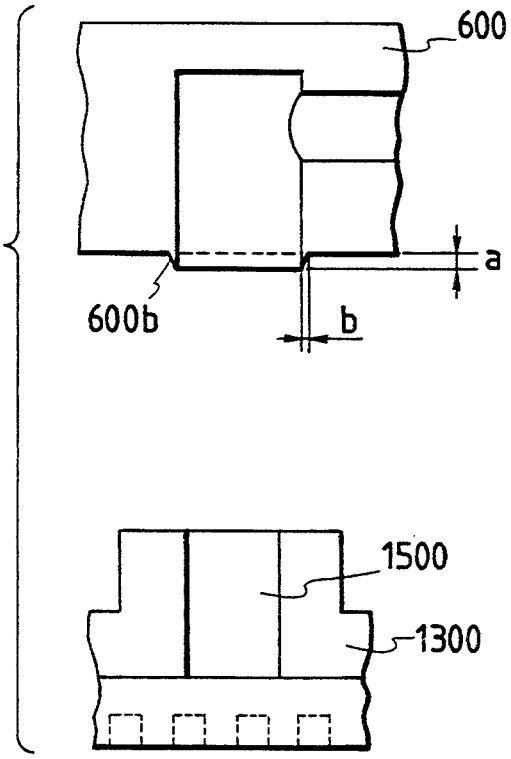
FIG. 6 is a cross sectional view which illustrates the ink supply passage member and the ceiling plate according to another embodiment of the present invention.
Figure 18:
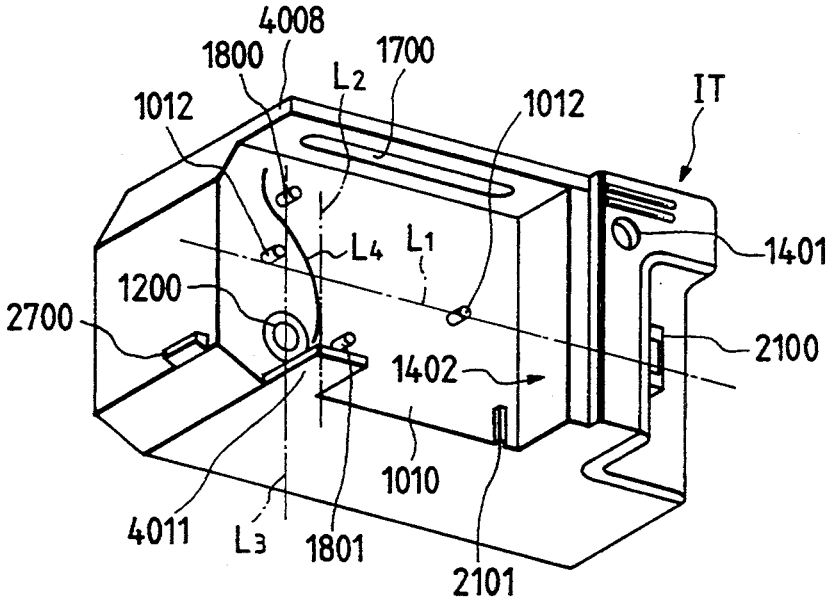
FIG. 18 is a schematic perspective view which illustrates the ink tank of the ink jet cartridge when viewed from a portion to which the ink jet recording head is fastened.

The structure of the surface of the ink tank IT to be fastened to the above-described unit IJU is shown in FIG. 6. Assuming that a straight line passing through the substantial center of the projection port of the orifice plate 400 as well as running in parallel to the bottom surface of the tank IT or the mounting reference plane on the surface of the carriage is $L_1$, the two locating projections 1012 to be engaged to the holes 312 formed in the supporting member 300 are positioned on the straight line $L_1$. The height of the projection 1012 is slightly lower than the thickness of the supporting member 300 so that the supporting member 300 can be located. Referring to FIG. 18, the structure is arranged in such a manner that a claw 2100, to which an engagement surface 4002 the angle of which is 90° of a carriage locating hook 4001 is engaged, is positioned on an extension line of the straight line $L_1$ so that the working force for locating the carriage acts on the plane region running parallel to the above-described reference surface including the straight line $L_1$. As described later with reference to FIG. 19, the above-described relationship is an effective structure because the locating accuracy for only the ink tank can be made to be the same as the locating accuracy of the discharge port formed in the head.

The projections 1800 and 1801 of the ink tank corresponding to fixing holes 1900 and 2000 to fix the supporting member 300 to the side surface of the ink tank are made to be longer than the above-described projection 1012. As a result, they penetrate the supporting member 300 and the portion projecting over it is fused with heat so that the supporting member 300 is fixed to the side surface of the ink tank. Assuming that a straight line running perpendicular to the above-described line Ll and passing through the above-described projection 1800 is $L_3$ and that passing through the projection 1801 is $L_2$, the substantial center of the above-described supply port 1200 is positioned on the straight line $L_3$. Therefore, the status of connection established between the supply port 1200 and the supply pipe 2200 can be stabled. As a result, load undesirably applied to the connected members due to drop or impact can be satisfactorily reduced. Furthermore, the straight lines $L_2$ and $L_3$ do not coincide with each other and as well the projections 1800 and 1801 are present in the vicinity of the projection 1012 of the head IJH adjacent to the discharge port. Therefore, the locating effect of the head IJH to the tank can be further improved. A curve $L_4$ designates the position of the outer wall when the ink supply member 600 is fastened. Since the projections 1800 and 1801 are formed along the curve $L_1$, satisfactory large strength and position accuracy can be obtained against weight of the front end structure of the head IJH. Reference numeral 2700 represents a front flange of the ink tank IT to be inserted into a hole formed in a front plate 4000 of the carriage. As a result, a problem taken place in that the displacement of the ink tank becomes excessively deteriorated can be overcome. Reference numeral 2101 represents a stopper provided with respect to the carriage HC, the stopper being provided for a bar (omitted from illustration) of the carriage HC. When the cartridge IJC is rotated and fastened as described later, the stopper 2101 is introduced into a portion below the bar at this position. As a result, it serves as a protection member acting to maintain the state of fastening even if upward force which causes undesirable removal from the located position acts.

The ink tank IT covers the cover 800 after the unit IJU has been fastened to it so that it is formed into a shape which surrounds the unit IJU except for the downward opening. The ink jet cartridge IJC is arranged in such a manner that its downward opening, with which the ink jet cartridge IJC is mounted on the carriage HC, is positioned adjacent to the carriage HC. Therefore, a space, the four directions of which are substantially surrounded, is formed. Therefore, heat generated from the head IJH disposed in the above-described surrounded space causes an effect of maintaining the temperature in the above-described space. However, the temperature slightly rises if the apparatus is used continuously for a long time. To this end, this embodiment is arranged in such a manner that a slit 1700 the width of which is smaller than the above-described space is formed above the cartridge IJC in order to cause the supporting member to smoothly naturally emit heat. As a result, the temperature distribution in the overall body of the unit IJU can be made uniform regardless of the atmospheric condition while preventing undesirable temperature rise.

When the ink jet head cartridge IJC is assembled, ink is supplied to the inner portion of the supply tank 600 from the inside portion of the cartridge via the supply port 1200, the hole 320 formed in the supporting member and an introduction port formed in the reverse side of the intermediate portion of the supply tank 600. After ink has passed through the inner portion of the supply tank 600, it is introduced through a discharge port into the common liquid chamber via proper supply pipes and the ink introduction port 1500 formed in the ceiling plate 400. In the junction portions through which ink passes, packings each of which is made of, for example, silicon rubber or butyl rubber are disposed so that a sealing effect is obtained and thereby the ink supply passage is formed.

According to this embodiment, the ceiling plate 1300 is made of a resin displaying excellent ink resistance such as polysulfone, polyether sulfone, polyphenylene oxide and polypropylene and integrally and simultaneously molded with the orifice plate portion 400 in a mold.

As described above, the ink supply member 600, the ceiling plate and the orifice plate integrated and the ink tank body 1000 are integrally formed members. Therefore, the assembling accuracy can be improved and as well a significant advantage can be realized when a mass production process is employed. In addition, the number of elements can be reduced in comparison to that required in the conventional apparatus. As a result, desired characteristics can be reliably realized.

As shown in FIGS. 16 to 18, this embodiment is arranged in such a manner that the ink supply member 600 has a top surface portion 603 which, as shown in FIG. 17, forms slit S in association with an end portion 4008 of the roof portion having the slit 1700 formed in the ink tank IT. A lower surface portion 604 forms a slit (omitted from illustration), which is similar to the above-described slit S, in association with a head end portion 4011 of a thin plate member to which the lower cover 800 of the ink tank IT. The slits formed between the ink tank IT engages and the ink supply member 600 act to substantially improve the effect of causing heat of the above-described slit 1700 to be emitted. In addition, even if unnecessary pressure is applied to the tank IT, direct application of the pressure to the supply member is prevented and therefore application of the same to the ink jet unit IJT is prevented.

Any one of the structures according to this embodiment is structured in a novel manner and as well an effect can be obtained from any one of the structures. Furthermore, in a case where they are combined with one another, an effect can be obtained.

(iii) Fastening of Ink Jet Head Cartridge IJC to Carriage HC

Referring to FIG. 19, reference numeral 5000 represents a platen roller which upwardly guides recording medium P from the lower portion of the sheet. The carriage HC moves along the platen roller 3000 and comprises a front plate 4000 (thickness: 2 mm) formed in the front portion of the carriage adjacent to the platen such that it is positioned to confront the front surface of the ink jet cartridge IJC, a flexible sheet 4005 having a pad 2011 which corresponds to a pad 201 of the circuit board 200 of the cartridge IJC, an electric connection supporting member 4003 for holding a rubber pad sheet 4007 which generates elastic force which presses the flexible sheet 4005 to each pad 2011 from the reverse side and a locating hook 4001 for securing the ink jet cartridge IJC to a recording position. The front plate 4000 has two locating projection surfaces 4010 to correspond to the above-described locating projections 2500 and 2600 of the supporting member 300 of the cartridge. Therefore, it receives perpendicular force applied toward the projection surface 4010 after the cartridge has been fastened. As a result, a reinforcing rib has a plurality of ribs (omitted from illustration) which are applied in the perpendicular direction on the portion of the front plate adjacent to the platen roller. The above-described rib also forms a head protecting projection portion which projects toward the platen roller by a slight degree (about 0.1 mm) over front surface position $L_5$ in a state where the cartridge IJC has been fastened. The electric connecting supporting plate 4003 has a plurality of reinforcing ribs 4004 in the perpendicular direction in place of the direction of the above-described rib in such a manner that the degree of the projection is decreased in a direction from the platen to the hook 4001. This arrangement of the structure acts to incline the position when the cartridge has been fastened as illustrated. Furthermore, the supporting plate 4003 has two hook-side locating surfaces 4006 to correspond to the projection surface 4010 for the purpose of applying a force acting on the cartridge in a direction opposing the direction in which the above-described two locating projection surfaces 4010 acts on the cartridge so that the electrical contact state is stabilized. As a result, a pad contact region is formed in the thus-formed space and as well as the amount of deformation of a boss of a rubber sheet 4007 having bosses which correspond to the pad 2011 is defined. The above-described locating surfaces are brought into a state in which they are positioned in contact with the surface of the circuit board 3000 when the cartridge IJC has been fixed to a position at which recording can be performed. According to this embodiment, the pad 201 of the circuit board 300 is distributed to be symmetric with respect to the above-described line $L_1$. Therefore, the amount of deformation of each boss of the rubber sheet 4007 is equalized so that the pressure level at which each boss is positioned in contact with the pads 2011 is further stabilized. The pads 201 are distributed such that two columns are arranged in both the upper and the lower portions and two columns are arranged longitudinally.

The hook 4001 has an elongated hole to be engaged to a fixed shaft 4009 so as to rotate counterclockwise from the illustrated position by utilizing the movable space realized by the above-described elongated hole. Then, the hook 4001 is moved to left along the platen roller 5000 so that the ink jet cartridge IJC is located with respect to the carriage HC. The present invention is not limited to the way of the movement of the hook 4001. However, it is preferable that a structure be employed which is arranged in such a manner that the movement can be performed by means of a lever or the like. In any case, at the time of the rotation of the hook 4001, the locating projections 2500 and 2600 are moved to positions at which they are able to come in contact with the locating surface 4010 of the front plate while moving the cartridge IJC to the platen roller. As a result of the movement of the hook 4001 to the left, a 90°-hook surface 4002 causes the cartridge IJC to rotate in a horizontal plane while making the contact region between the locating surfaces 2500 and 4010 to be the center while coming into contact with the 90°-place of the claw 2100 of the cartridge IJC. As a result, the pads 201 and 2011 come in contact with each other. When the hook 4001 is held at a predetermined position, that is, the position at which the same must be fixed, the perfect contact between the pads 201 and 2011, the perfect contact between the locating surfaces 2500 and 4010, the two planes contact between the 90° -surface 4002 and the 90° -surface of the claw and the surface contact between the circuit board 300 and the locating surface 4006 are simultaneously realized. As a result, the cartridge IJC is held with respect to the carriage.

An embodiment of the present invention for improving the air tightness in the structure shown in FIGS. 16 and 17 will now be described. The same elements as those shown in FIGS. 16 and 17 are given the same reference numerals and therefore their description are omitted here.

First, the ink supply passage to supply ink to the ink jet head IJH according to this embodiment will now be described.

Figure 1:
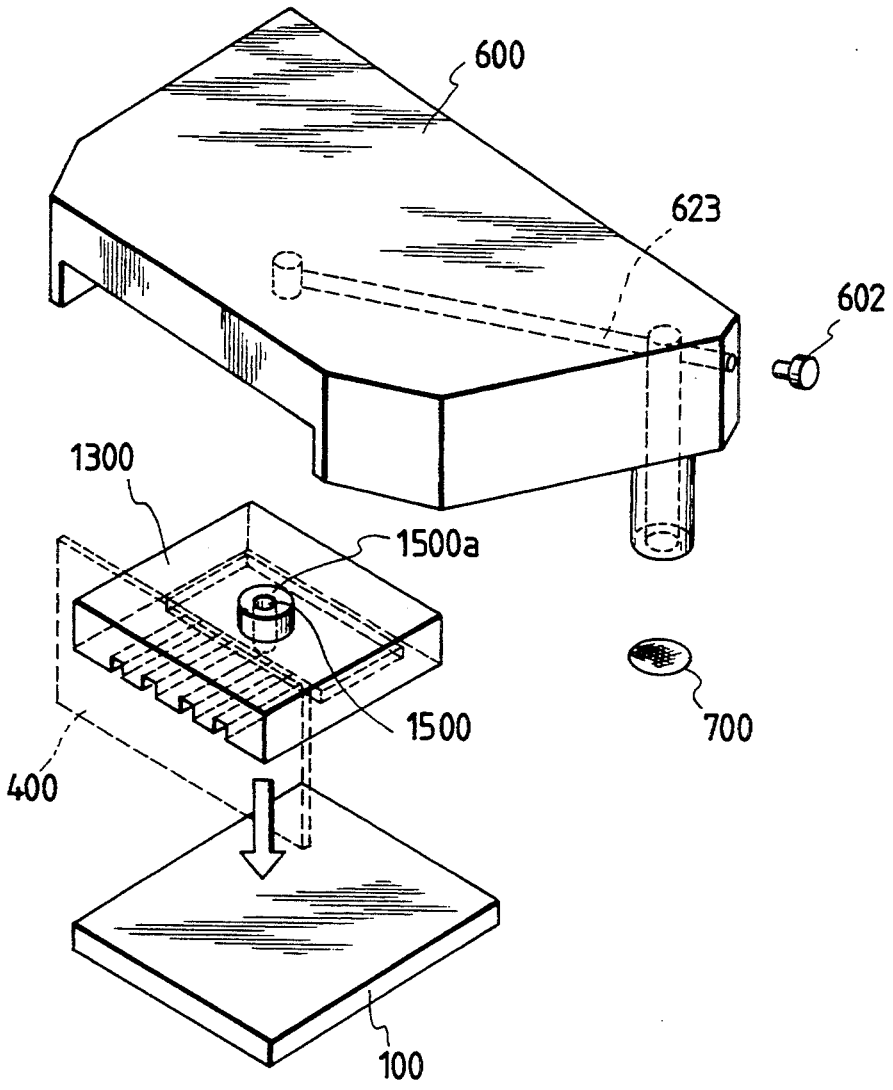
FIG. 1 is an exploded perspective view which illustrates the structure on a recording head and an ink supply passage member according to an embodiment of the present invention.

FIG. 1 is an exploded perspective view which illustrates the schematic structure of a recording head according to an embodiment of the present invention.

The ceiling plate 1300 has a plurality of ink discharge ports, liquid passages communicating with the ink discharge ports and a groove for forming a common liquid chamber commonly communicated with each liquid passage. Furthermore, the ceiling plate 1300 has a hole for forming the ink receiving port 1500 formed at the position which corresponds to the common liquid chamber and a projection **1500*a*. The heater board 100 has electrothermal converting members serving as the discharge energy generating devices at positions corresponding to the provided liquid passages. The ink supply passage member 600 has an ink passage 623 for supplying ink from the ink tank to the ink receiving port 1500**.

Figure 2:
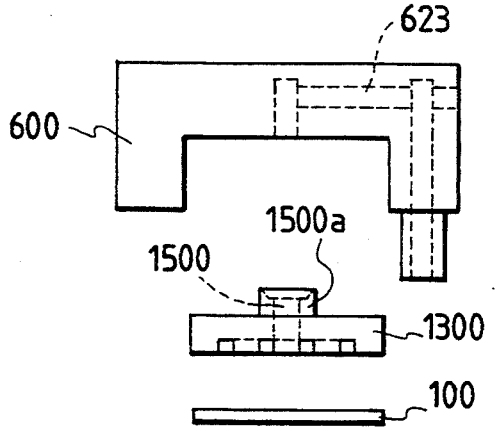
FIG. 2 is a front elevational view which illustrates the structure shown FIG. 1 in an exploded manner.
Figure 3:
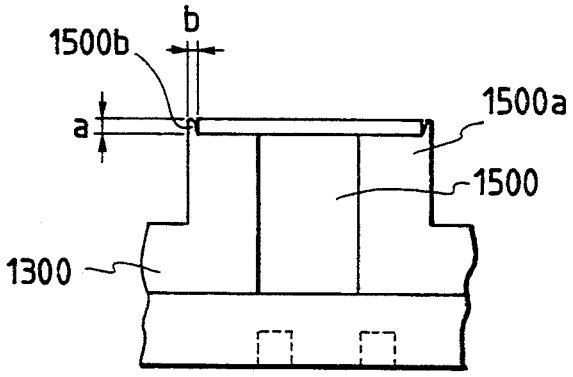
FIG. 3 is a cross sectional view which illustrates the detailed structure of an ink receiving port formed in the ceiling plate shown in FIG. 1.

FIG. 2 is a front elevational view which illustrates each of the above-described elements. FIG. 3 is a cross sectional view which illustrates a portion including the ink receiving port 1500 having the ceiling plate 1300 which is the connecting portion to be connected to the ink jet head portion.

A burr-like deformable annular projection **1500*b* the width b of which is about 0.005 to 0.1 mm and the height a of which is about 0.01 to 0.2 mm is integrally formed on the top surface of the projection 1500***a* which constitutes the receiving port 1500.

Figure 4:
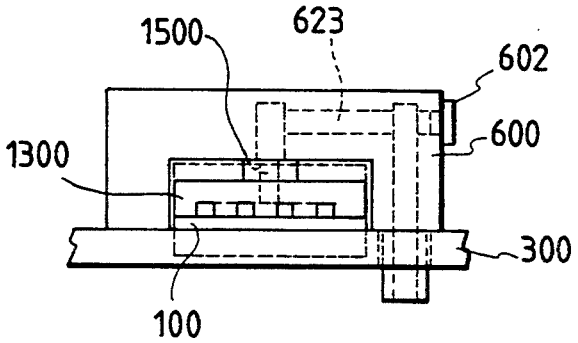
FIG. 4 is a front elevational view which illustrates the structure shown in FIG. 1 in a connected state.
Figure 5:
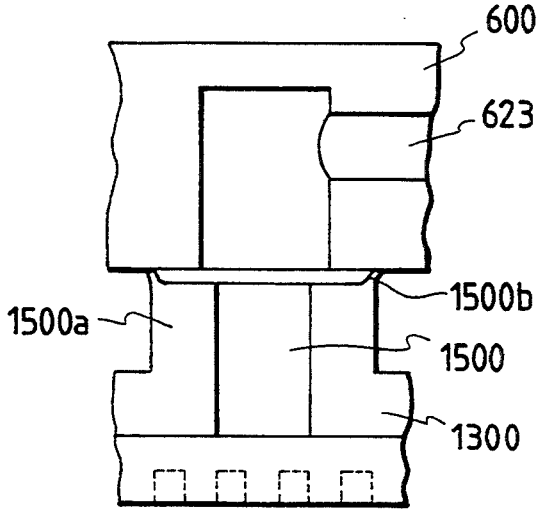
FIG. 5 is a cross sectional view which, in detail, illustrates the connection established between the projection of the ink receiving port and the ink supply passage member in a state shown in FIG. 4.

FIG. 4 is a front elevational view which illustrates a state in which the ink supply passage member 600 and the recording head are fastened to each other. FIG. 5 is a cross sectional view which illustrates the connection established between the projection 1500*a* and the connecting portion of the ink supply passage member 600 in the above-described state.

The ink supply passage member 600 is caulked by heat at its surface to be connected to the supporting member 300 so that it is secured to the surface of the supporting member 300. At the time of the heat caulking, the ink supply passage member 600 is brought into contact with the ceiling plate 1300. As a result, the annular projection 1500*b* of the ceiling plate 1300 is crushed so that the ink supply passage member 6000 and the projection 1500*a* of the ink receiving port 1500 are brought into contact with each other in a hermetical manner. The force for deforming the annular projection 1500*b* is about 100 to 300 g according to this embodiment.

Since the ink supply passage member 600 is a resin molded element, it is difficult to completely form the ink passage 623 by only molding due to the limitation present in the structure of the mold. Therefore, a plug 602 is press-fit into the ink passage 623 so that the ink passage is formed. An end portion of the ink passage 623 at which the filter 700 is disposed is arranged to introduce ink placed in the ink tank when it is pressed to foam material which contains ink in the ink tank.

FIG. 6 is a cross sectional view which illustrates the ink supply passage member and the ceiling plate according to another embodiment of the present invention.

According to this embodiment, the annular projection 600*b* which is crushed at the time of the connection operation is formed adjacent to connecting portion of the ink supply passage member 600. In this case, the surface of the member 600 on which the projection 600*b* is formed is recessed by a certain degree from the surface at which the supporting member 300 is connected. Therefore, it can be easily handled because it is not easily deformed at the time of the manufacturing process or the like in comparison to the case in which the annular projection 1500B is formed on the ceiling plate 1300 according to the above-described embodiment.

If the force for connecting the ink supply passage member 600 and the ceiling plate 1300 can be enlarged, a structure may be employed in which both of the projection 600*b* and the projection 1500*b* are formed in such a manner that they do not interfere with each other and as well as each of them are crushed at the time of the connection, resulting a satisfactory effect to be obtained in terms of improving the adhesion.

Figure 7A:
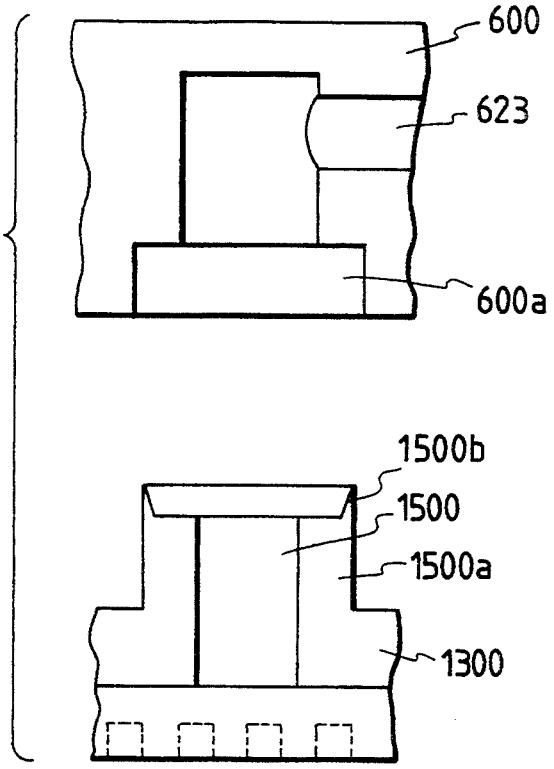
FIGS. 7A and 7B are cross sectional views which illustrate a modification to the embodiment shown in FIG. 1.
Figure 7B:
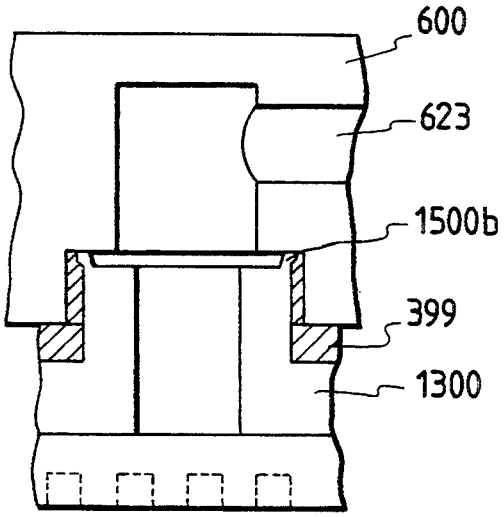

FIGS. 7A and 7B illustrate a modification to the structure shown in FIG. 2. According to this modification, a fastening portion 600*a* is formed in the ink supply passage member 600, the fastening portion 600*a* being fastened to the projection 1500*a* of the receiving port 1500. As a result, a relative large quantity of a sealant 399 can be used in the state of the connection shown in FIG. 7B. Furthermore, the distance between the connecting portion between the ink supply passage member 600 and the ceiling plate 1300 and outer air is increased so that air cannot be introduced into the ink supply passage. Furthermore, in a case where a sealer having elasticity such as a silicon type sealer and a urethane type sealer is used as the above-described sealer, distortion generated in the connecting portion due to heat or mechanical vibrations can be absorbed.

Figure 8A:
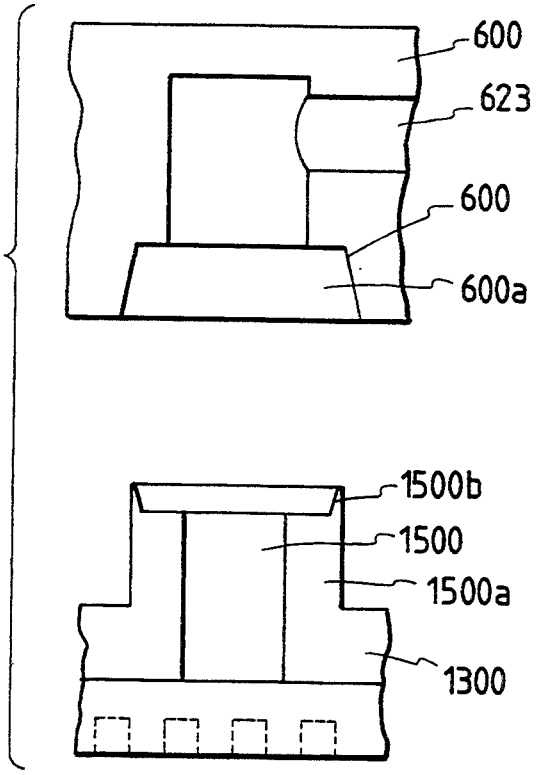
FIGS. 8A and 8B are cross sectional views which illustrate another modification to the embodiment shown in FIG. 1.
Figure 8B:
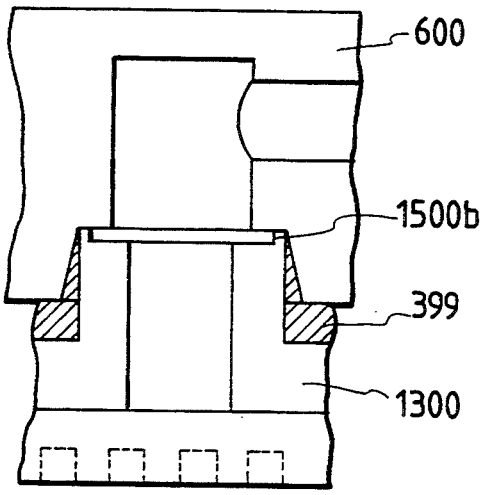

FIGS. 8A and 8B illustrate a modification to the structure shown in FIG. 7. According to this modification, the fastening portion 600*a* has a tapered portion 600*c*. As a result, it can be brought into contact with a portion of the side surface of the projection 1500*a* of the ceiling plate 1300 in a hermetical manner after it has been fastened to the ceiling plate 1300. Therefore, the adhesion can further be improved in addition to the effect realized by the adhesion with the annular projection 1500*b*. Furthermore, it is preferable that the structure shown in FIG. 8 be arranged in such a manner that the connecting portion be sealed by the sealer 399 similarly to the structure shown in FIG. 7.

The necessity of forming the above-described annular projection 1500*b* or 600*b* at the time of forming the ceiling plate or the ink supply passage member can be eliminated. That is, the annular projection may be formed by utilizing burrs generated in the opening portion of the ink receiving port 1500 or that of the ink passage 623 when the ceiling plate or the like is formed. The structure shown in FIGS. 7 and 8 may be arranged in such a manner that the projection portion is formed adjacent to the ink supply passage member similarly to the structure shown in FIG. 6.

As a result of the thus-arranged structure, the free end portion of the cantilever type conducting pipe must be capable of moving. On the other hand, the portion at which the ink supply passage member comes in contact with the recording head must be sealed at the time of working the ink sucking function or the like. In a case where there is a necessity of providing a certain gap between the above-described portion at which the ink supply member comes in contact and the free end portion of the conducting pipe, the size of the ink supply passage member can be reduced. Furthermore, since the ink supply passage member is made of a resin, the mold can be simplified and the same can be manufactured with low cost. Furthermore, by forming a projection which comes in contact and which is deformed at the connecting portion between the recording head and the ink supply passage member, the relative dimensional error between the recording head and the ink supply passage member can be absorbed to realize perfect contact at the connecting operation. In addition, the projection portion can be formed from the burrs or the like generated at the time of performing molding by using a resin. Therefore, the projection portion can be formed while eliminating a necessity of performing a special process.

As a result, the movable portion can be omitted from the ink supply passage member, causing effects to be obtained in that the size of the supply passage member can be reduced and the mold for manufacturing it can be produced at low cost. As a result, the overall cost of the ink jet recording head can be reduced.

Since the deformed portion is able to come in contact with the entire surface, another effect can be obtained in that ink leakage and undesirable introduction of the sealer can be prevented. As a result, the reliability can be improved.

Then, a preferable sealer according to this embodiment for use in a portion which establishes a connection between the recording head and the ink supply passage member, in the ink jet head (IJH) portion and in its adjacent portion will now be described with reference to a case in which the ink jet head (IJH) portion and its adjacent portion are sealed.

Figure 9:
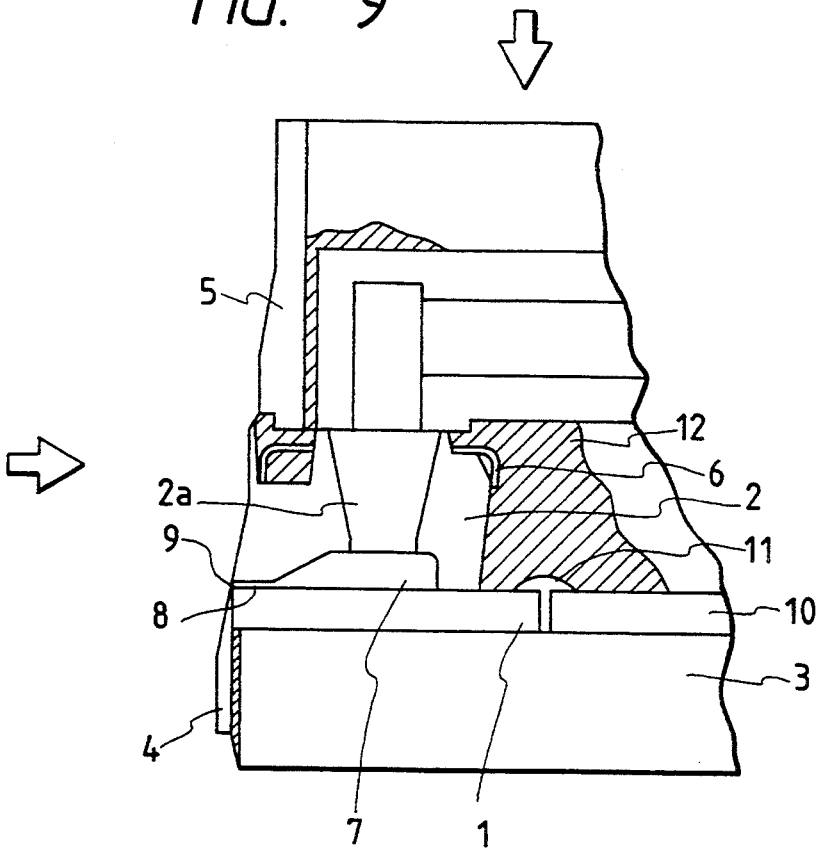
FIG. 9 is a schematic cross sectional view which illustrates an embodiment of the ink jet head according to the present invention.
Figure 10:
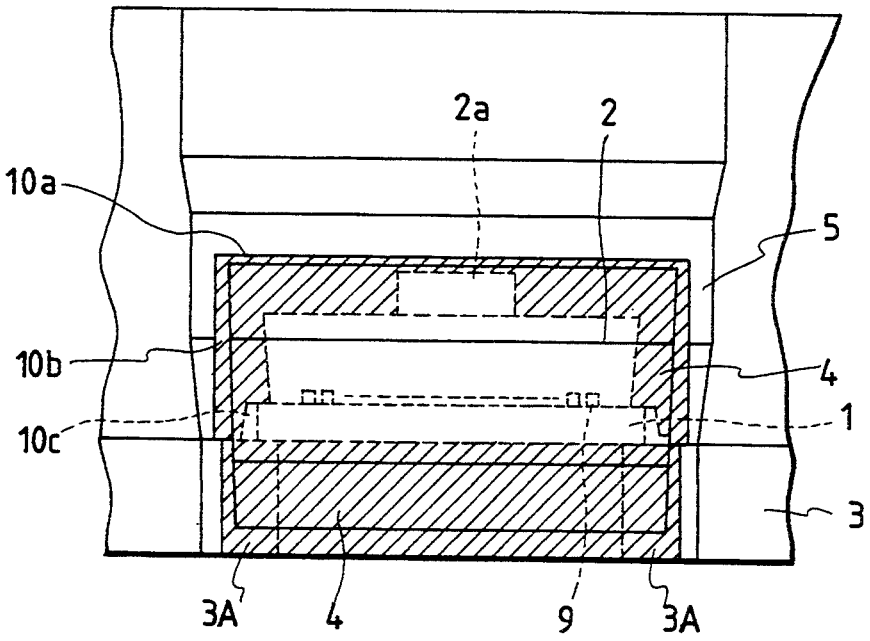
FIG. 10 is a schematic front elevational view when viewed from a portion including the discharge port shown in FIG. 1.

FIGS. 9 and 10 illustrate an embodiment in this case. As described in "Related Art Statement", the ink jet head comprises a substrate 1 (hereinafter called a "heater board") on which an ink discharging pressure generating device is formed, a liquid chamber 7 connected to the substrate 1 and accommodating recording medium (hereinafter called "ink") and a substrate 2 having projection and recessed portions which constitute an ink passage 8. The above-described substrate 2 integrally has an orifice plate 4 (hereinafter called a "grooved ceiling plate") which has ink discharge port 9 communicated with the ink passage 8 and acting to discharge ink.

The heater board 1 is allowed to adhere to a supporting substrate 3 by an adhesive agent, while the grooved ceiling plate 2 is disposed on the surface of the heater board 1 in such a manner that a heater portion disposed on the heater board 1 and serving as an ink discharging pressure generating device coincides with the ink passage 8 formed in the grooved ceiling plate 2. Furthermore, the orifice plate 4 which is the grooved ceiling plate is disposed on the front surface of the supporting substrate 3 in such a manner that it is downwardly hung.

Ink is supplied from an ink supply member 5 after it has passed through an ink supply port 2*a* formed in the upper portion of the grooved ceiling plate. The ink supply member 5 has a projection rod which is inserted into a through hole formed in the supporting substrate before they are caulked by heat so that the ink supply member 5 is secured to the supporting substrate.

The sealer is introduced into small gaps 10*a* and 10*b* between the ink supply member 5, the heater board 1 and the grooved ceiling plate 2 and the like. Furthermore, the same is introduced into an adhesive space in the connecting region to which the adhesive agent is introduced and which has small gaps formed between the orifice plate and the front surface of the supporting substrate.

The thickness of a portion adjacent to the discharge portion formed in the orifice plate 4 which constitutes the ink jet head is about 30 to 40 μm. It is preferable that it be increased in a direction toward the lower portion of the supporting substrate 3. The same is made to be 0.2 mm according to this embodiment.

In order to reduce the cost of the material and to improve the resistance against ink, the grooved ceiling plate 2 having the orifice plate 4 may be made of thermal plastic resin such as polyimide, polyethyletherketone, polysulfone or the like.

Figure 11:
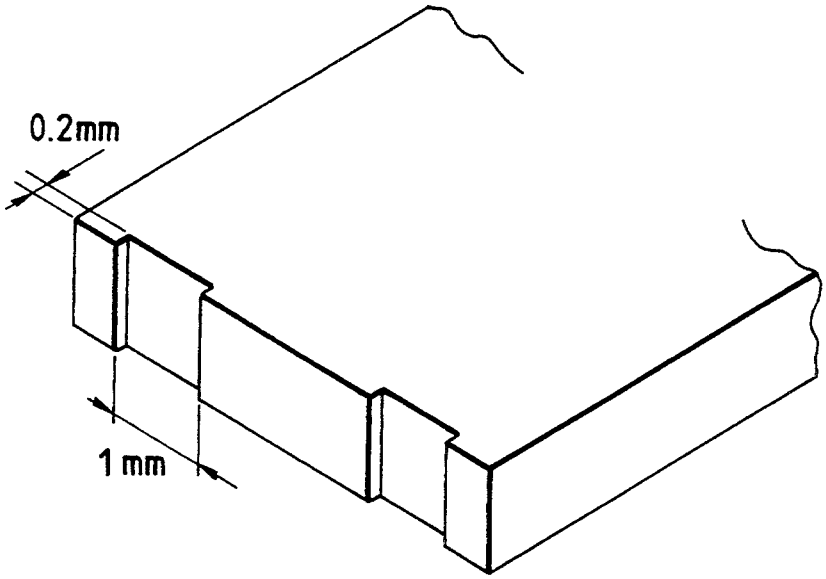
FIG. 11 is a schematic perspective view which illustrates an example of the supporting substrate which constitutes the ink jet head according to the present invention.

According to embodiment, polysulfone which displays a small deformation quantity even if the temperature is high. FIG. 10 is a front elevational view which illustrates the ink jet head. Referring to FIG. 10, the diagonal-line portion shows a region filled with the sealer. The supporting substrate 3 has grooves 3A formed on the two sides thereof. As shown in FIG. 11, this embodiment is arranged in such a manner that the groove 3A is made such that its width is 1 mm and the depth is 0.2 mm. The present invention is not limited to the above-described size of the groove 3A if the groove is formed such that the sealer can be satisfactorily enclosed into the same. The heater board is secured to the surface of the supporting substrate 3 by an adhesive agent and as well as the grooved ceiling plate 2 is secured by mechanical urging force realized by a retaining spring 6 temporarily fastened to the surface of the heater board 1 by an adhesive agent in such a manner that the heater portion disposed on the heater board 1 coincides with the ink passage 7 formed in the grooved ceiling plate 2. The grooved ceiling plate 2 has the orifice plate 4 in such a manner that the orifice plate 4 is disposed to hang at the front surface of the supporting substrate 3. The ink supply member 5 is secured to the supporting substrate 3 in such a manner that a projection rod (omitted from illustration) formed on the ink supply member is made into coincide with a through hole formed in the supporting substrate 3 before they are caulked by heat. At this time, uniform gaps 10*a* and 10*b* are formed between the orifice plate 4 and the ink supply member 5. According to this embodiment, each of the gaps 10*a* and 10*b* is made to be 0.1 to 0.2 mm.

The groove 3A formed in the supporting substrate 3 must form a space which is continued from the gap formed between the orifice plate 4 and the ink supply member 5. It is not preferable that the groove 3A is perfectly covered by the orifice plate 4 or that the same is individually formed from the above-described gaps 10*a* and 10*b*. The reason for this lies in that the passage through which the injected sealer is disconnected or satisfactory sealing cannot be realized.

The groove 3A in the front surface of the supporting substrate 3 is formed by pressing in terms of necessity that it must be manufactured by mass production.

The sealer is injected through the sealer injection port (omitted from illustration) formed in the upper portion of the ink supply member 5 so that the wire bonding portion 11 for transmitting an electric signal is sealed and as well the gaps 10*a* and 10*b* between the orifice plate 4 and the ink supply member 5 are sealed. Then, the sealer passes through the groove 3A formed in the supporting substrate 3 so that the gap region between the orifice plate 4 and the front surface of the supporting substrate 3 is perfectly sealed. It is necessary for the sealer to seal the gap in such a manner that it does not cover the orifice 9, and therefore requires proper thixotropy and viscosity. That is, if the viscosity of the sealer is too low, the same can be introduced into the nozzle and the orifice disposed in the grooved ceiling plate 2, causing blinding to take place. If the same is too high, the sealer cannot satisfactorily reach the portion including the orifice plate 4.

Table 1 shows results of examinations made about the state of the supply of the sealer and blinding taken place in the orifice plate, the nozzle and the orifice by using sealers the viscosity of which are made to be 800, 4,000, 10,000 and 18,00 cps. Referring to Table 1, mark o designates an excellent sealer supply in the orifice plate portion and a state of no blinding in the nozzle orifice portion, while mark x designates unsatisfactory states.

TABLE 1

| Viscosity of Sealer | Supply of Sealer | |
|---|---|---|
| | Orifice Plate Portion | Nozzle Orifice Portion |
| 800 cps | ○ | x (blinding) |
| 1000 cps | ○ | Δ |
| 4000 cps | ○ | ○ |
| 10000 cps | ○ | ○ |
| 15000 cps | Δ | ○ |
| 18000 cps | x (not introduced) | ○ |

As can be seen from Table 1, the viscosity of the sealer according to the present invention is 1,000 to 15,000 cps, preferably 2,000 to 10,000 cps, and further preferably 4,000 to 10,000 cps.

The sealer must display excellent adhesion performed to the heater board made of silicone wafer, the supporting substrate 3 made of metal, the grooved ceiling plate 2, the orifice plate 4, and the ink supply member 5 and the like made of a synthetic resin. In order to connect a plurality of different materials each having different thermal expansion coefficients, soft material capable of absorbing the difference in the thermal expansion due to the temperature status must be used. Specifically, a sealer the hazardness of which is A100 of JIS or lower must be used.

Since the above-described sealer as well as acts to cover the wire bonding portion 11 to protect it, it must be made of material with which the aluminum wire bonding portion and the aluminum electrode is not corroded. In order to prevent corrosion of the electrode and the wire bonding, it is preferable that the density of impurity ions such as $Cl^-$ and $Na^+$ in the sealer be 30 ppm or less.

Furthermore, the above-described material must have excellent ink resistance, and, more particularly, solution resistance and alkali resistance because it partially comes in contact with ink. In addition, it must have low permeability with respect to oxygen, nitrogen and steam.

As a sealer which meets the above-described requirements, a urethane resin, an acrylic resin, a flexible epoxy resin and rubber type adhesive agent and the like may be used according to the present invention. It is further preferable that the material has the elasticity of rubber.

As the sealer which meets the above-described requirements, a double-liquid urethane adhesive agent the composition of which is as follows, and particularly, that which has a urethane bond —NHCOO— in its molecular structure was used:

| [Example of Compositions] (Main component) | |
|---|---|
| Polyetherpolyol | 100 parts by weight |
| Silane coupling agent | 5 parts by weight |
| Thixotropy agent | 1 part by weight |
| Colorant | 1 part by weight |
| (Hardening Agent) | |
| Polyisocyanate | 40 parts by weight |

Since the double-liquid urethane adhesive agent displays significantly low air permeability and steam permeability in comparison to the conventional silicon resin type adhesive agent, undesirable introduction of air into IJH can be prevented. Furthermore, evaporation of water contained in ink can be prevented.

As the above-described polyether polyol, that is, polyether type polyhydric alcohol, the following materials are exemplified: polyalkylene glycol such as polyethylene glycol and polypropylene glycol and the like and polytetramethylene glycol. The above-described materials may be used solely or in a state in which selected materials are combined with each other.

As the above-described polyisocyanate, the following materials are exemplified: an isocyanate trimer such as polymeric and an isocyanate dimer such as trilenediisocyanate, 4,4'-diphenylmethanediisocyanate, xylilenediisocyanate, naphthylenediisocyanate, paraphenylenediisocyanate, tetramethylxylilenediisocyanate, dicyclohexylmethanediisocyanate, isophoronediisocyanate, lysinediisocyanate, lysinediisocyanate, hydroxylilenediisocyanate, microhexyldiisocyanate and tridinediisocyanate. The above-described materials may be used solely or in a state in which selected materials are combined with each other.

The mixture ratio of the above-described polyetherpolyol and polyisocyanate is made to be 100 parts by weight: 40 parts by weight according to the above-described example. However, the present invention is not limited to this. Therefore, the above-described mixture ratio may be properly determined in accordance with the equivalent ratio between the hydroxyl group (OH group) of polyol and the isocyanate group (—N-CO—group) of polyisocyanate.

For example, aerozil may be used as the above-described thixotropy agent, the aerozil being an amorphous silica which gives excellent thixotropy characteristics to the urethane adhesive agent obtained from the above-described mixture.

The viscosity of the double-liquid urethane adhesive agent serving as the sealer according to the present invention is adjusted to be within the above-described range by changing the molecular weight of the urethane adhesive agent which can be changed in accordance with the polymerization degree at the time of urethane reaction taken place between the polyether polyol and polyisocyanate and the quantity of thixotropy agent added. Furthermore, the viscosity can be adjusted while sufficiently dispersing the thixotropy agent to a pre-polymer obtained by pre-polymerizing mixed polyetherpolyol and polyisocyanate.

In order to enlarge the bonding force between the above-described pre-polymer and the thixotropy agent, any one of the following silane coupling agent may be used: acrylic silane such as vinyltrichlorosilane, vinyltris ($\beta$ methoxyethoxy) silane, vinyltriethoxysilane and vinyltrimethoxysilane; epoxy silane such as $\beta$-(3,4-epoxycyclohexyl) ethyltrimethoxysilane, $\gamma$-glycidoxypropyltrimethoxysilane, $\gamma$-glycidoxypropylmethyldiethoxysilane; amino silane such as N-$\beta$ (aminoethyl) $\gamma$-aminopropyltrimethoxysilane, N-$\beta$ (aminoethyl) $\gamma$-aminopropylmethyldimethoxysilane, $\gamma$-aminopropyltriethoxysilane, N-phenyl-$\gamma$-aminopropyltrimethoxysilane; and silane compound such as $\gamma$-mercaptopropyltrimethoxysilane and $\gamma$-chloropropyltrimethoxysilane and the like.

A colorant may be arbitrarily added to the above-described sealer by a quantity which is determined in accordance with the color of the desired adhesive agent. The colorant is exemplified by inorganic colorant such as carbon black, titanium oxide, iron oxide, chrome oxide, cadmium sulfate, aluminomagnesium and lamp black and organic colorant such as azoic dye, diazoic dye, phthalocyanine and dioxazine.

In order to accelerate the urethane preparation reaction in the manufacturing process, a catalyzer may be added. The catalyzer may be exemplified by the following organic metal catalyzer: stannous octoate, dibutyltin diacetate, dibutyltin dilaurate, dibutyltinmercaptide, dibutyltinthiocarboxyte, dibutyltin dimaleate, dioctyltin mercaptide, dioctyltin thiocarboxylate, phenylmercuric propionate and octoate.

A bias of 24 v (DC) is added to IJC sealed by a urethane resin in which the total density of impurity ions contained in the sealer is made to be 10 ppm, 30 ppm and 50 ppm, and the samples were allowed to stand at a high temperature and high humidity condition of 80° C. and 85% RH for 200 hours before an electrical conductivity test was carried out. Thus, results shown in Table 2 were obtained.

TABLE 2

| Density of Impurity ions contained in sealer (ppm) | Time of Leaving: 200 H (85° C., 85% RH) |
|---|---|
| 10 | ○ |
| 30 | ○ |
| 50 | x |

Then, the sealing performance of the conventional silicon resin and that of the double-liquid urethane resin according to the present invention were evaluated.

Ink jet cartridges each integrally having an ink jet unit and an ink tank were mounted on the corresponding printers after the portions each including the recording head portion of the ink jet unit have respectively been sealed by a single-liquid RTV silicon resin and the double-liquid urethane resin. The printer was allowed to stand in a dry condition the temperature of which was 35° C. and the humidity of which was 20%. Then, no recovery operation was performed and an examination whether or not printing could be performed was carried out. The results are shown in Table 3. In Table 3, mark ○ designates a state where air in the unit was not introduced and printing could be performed while performing no recovery operation. Mark x designates a state where printing could not be performed if the recovery operation was not performed since air was introduced. The air permeability shown in Table 3 was shown in units of [$cm^3$][cm]/[sec][$cm^2$][cmHg]. The permeability of air was measured by employing a gas permeability test method regulated by JIS.

TABLE 3

| Sealer | Air Permeability | Allowed to stand at 35° C. in a dry state | | | |
|---|---|---|---|---|---|
| | | 3 days | 7 days | 15 days | 30 days |
| Silicone resin (KE471 manufactured by Shinetsu Chemical) | about $400 \times 10^{-10}$ | ○ | X | X | X |
| Double-liquid urethane resin (Ekosen manufactured by Grace Japan) | about $30 \times 10^{-10}$ | ○ | ○ | ○ | ○ |
| Butadiene rubber (NF35A manufactured by Asahi Kasei) | about $10 \times 10^{-10}$ | ○ | ○ | ○ | ○ |

As described above, the urethane resin and the butadiene rubber which display a low air permeability of the order of $10^{-9}$ resuled an excellent printing performance even if they have been allowed to stand for 30 days in comparison to a silicon resin the air permeability of which is in the order of $10^{-8}$.

Furthermore, the steam permeability was evaluated by the test conducted in the same manner as that shown in Table 3 and its results are shown in Table 4. The steam permeability was evaluated by using the permeability test method regulated by JIS.

TABLE 4

| Sealer | Steam Permeability | Allowed to stand at 35° C. in a dry state | | | |
|---|---|---|---|---|---|
| | | 3 days | 7 days | 15 days | 30 days |
| Silicone resin (KE471 manufactured by Shinetsu Chemical) | about $40000 \times 10^{-10}$ | ○ | x | x | x |
| Double-liquid urethane resin (Ekosen manufactured by Grace Japan | abut $1500 \times 10^{-10}$ | ○ | ○ | ○ | ○ |
| Butadine rubber (NF35A manufactured by Asahi Kasei) | about $5000 \times 10^{-10}$ | ○ | ○ | ○ | Δ |
| Flexible double-liquid urethane resin (XN2248 manufactured by Nihon Bernox) | about $1000 \times 10^{-10}$ | ○ | ○ | ○ | ○ |

Also the sealer which displays a low steam permeability in the order of $10^{-7}$ showed excellent results as shown in Table 4 in comparison to the silicon resin which displayed a high steam permeability in the order of $10^{-6}$.

A method of sealing the connected portion according to another embodiment and capable of improving the handling facility will now be described.

In general, in order to uniformly seal the gap and the connected portion, characteristics such as the size of the gap, the viscosity of the sealant, and the time required to be hardened, and the like must be strictly controlled. It will be described with reference to those for the head unit. As shown in FIG. 10, it is preferable that the gaps 10*a* and 10*b* between the ink supply member 5, the heater board 1 and the grooved ceiling plate 2 and the gap between the orifice plate 4 and the front surface of the supporting substrate 3 be small enough to introduce the sealer by its capillary and as well as large enough to realize a uniform introduction flow. However, if the viscosity of the sealer is too low or the quantity of the sealer introduced is too large, it is undesirably discharged through the gap before it is hardened. Furthermore, there arises a risk of covering the ink discharge port 9 after it has been introduced into the connecting portion 10*c* between the heater board 1 and the grooved ceiling plate 2. If the viscosity is too high or the quantity of the sealer introduced is too small, it is undesirably hardened before it is introduced. Therefore, it is difficult to arrange the balance between the viscosity, the hardening time and the quantity of the sealer introduced.

Furthermore, in order to uniformly seal the gap and perfectly seal the connected portion, a sealer having proper viscosity and hardened in a relatively long time must be used. Therefore, it takes a too long time to completely harden the sealer, causing a problem to take place in that a satisfactory manufacturing efficiency cannot be realized. In this case, the designed shape and the size of the portion into which the sealer is introduced sometimes arises a necessity of injecting a proper quantity of the sealer by several times in a case of a required quantity of the sealer is large. Furthermore, the moment at which the sealer, which has been introduced previously, is hardened enough so as not to be undesirably discharged through the gap by the sealer introduced newly or undesirably introduced into the connected portion is waited for.

In particular, according to this embodiment, a photosetting rein is used as the sealer which is able to meet the above-described requirements.

According to this embodiment, for example, an ultraviolet hardening adhesive agent is used as the photosetting resin.

According to this embodiment, the sealer is, in a state where pre-premerization flow of it is enabled, introduced through an injection port (omitted from illustration) formed in the ink supply member 5 shown in FIG. 10 into the gaps 10*a* and 10*b* formed between the wire bonding portion, orifice plate 4 and the ink supply member 5. Then, it passes through the groove 3A formed in the supporting substrate 3 before it reaches the gap region between the orifice plate 4 and the front surface of the supporting substrate 3 so as to be hardened by an ultraviolet hardening apparatus.

As the main component of the ultraviolet ray hardening type adhesive agent preferably used as the sealer according to the present invention, the following photopolymerizing prepolymer (oligomer) may be used: polyesteracrylate, epoxyacrylate, polyetheracrylate, oligoacrylate, alkidaclylate, polyolacrylate, melamineacrylate, or silicon acrylate or the like.

A photoinitiator is added to the main component of the above-described ultraviolet hardening adhesive agent by a desired quantity. The photoinitiator is exemplified by biacetyl, acetophenone, benzophenone, schiller ketone, benzil, benzoil, benzoinisobutylether, benzildimethylketal, tetramethylthiuram disulfide, azobisisobutylnitryl, benzoilperoxide, di-tert-butylperoxide, 1-hydroxycyclohexylphenylketone, 2-hydroxy-2-methyl-1-phenylpropane-1-on, 1 (4-isopropylphenyl)-2-hydroxy-2-methylpropane-1-on, 2-chlorothioxantone and methylbenzoyl formate.

In order to perfectly harden the sealer introduced into the gap region positioned between the orifice plate 4 and the front surface of the supporting substrate 3, it is preferable that the grooved ceiling plate 2 be made of transparent or semitransparent material. In this case, the material for the grooved ceiling plate 2 is exemplified by: polysulfone, polyarylsulfone, polyethersulfone, polycarbonate, polymethacrylic acid, polyphenyleneoxide, polyarylate, ABS resin and acrylc resin.

It is preferable that the direction in which the ultraviolet rays are applied be, as designated by an arrow shown in FIG. 9, made to be a direction to the orifice plate 4 and the upper opening portion 5 formed in the supply member 5.

In a case where the ink supply member 5 is made of transparent or semitransparent material, it is necessary for the ultraviolet rays to be applied in only one direction. Therefore, the structure of the ultraviolet ray irradiating apparatus can be simplified.

ANOTHER EMBODIMENT

Figure 12:
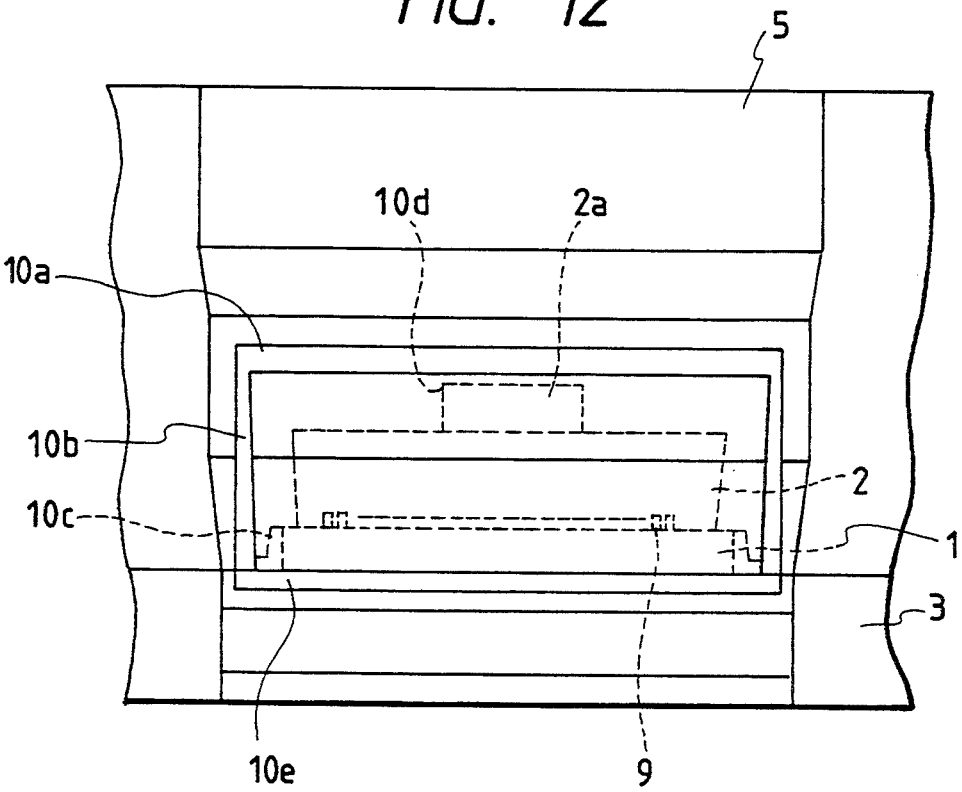
FIG. 12 is a schematic front elevational view which illustrates another embodiment of the present invention.

FIG. 12 illustrates another embodiment. This embodiment is arranged in such a manner that no orifice plate is provided for the grooved ceiling plate but the entire surface of the supporting substrate is covered with the ink supply member 5 and as well a small gap 10*e* is formed in a space from the grooved ceiling plate 2.

This embodiment is structured in such a manner that the sealer is introduced into all of the gaps 10, 10*b* and 10*e* formed between the ink supply member 5 and the grooved ceiling plate 2. The sealer introduced into the above-described gaps 10*a*, 10*b* and 10*e* can be hardened with ultraviolet rays even if the grooved ceiling plate 2 which appears outside is not made of the transparent or semitransparent material. Therefore, the grooved ceiling plate 2 can be made of material selected relatively freely. Furthermore, since the groove 3A can be omitted from the supporting substrate 3, the manufacturing cost can be reduced.

The Schematic Structure of the Body of Apparatus

Figure 13:
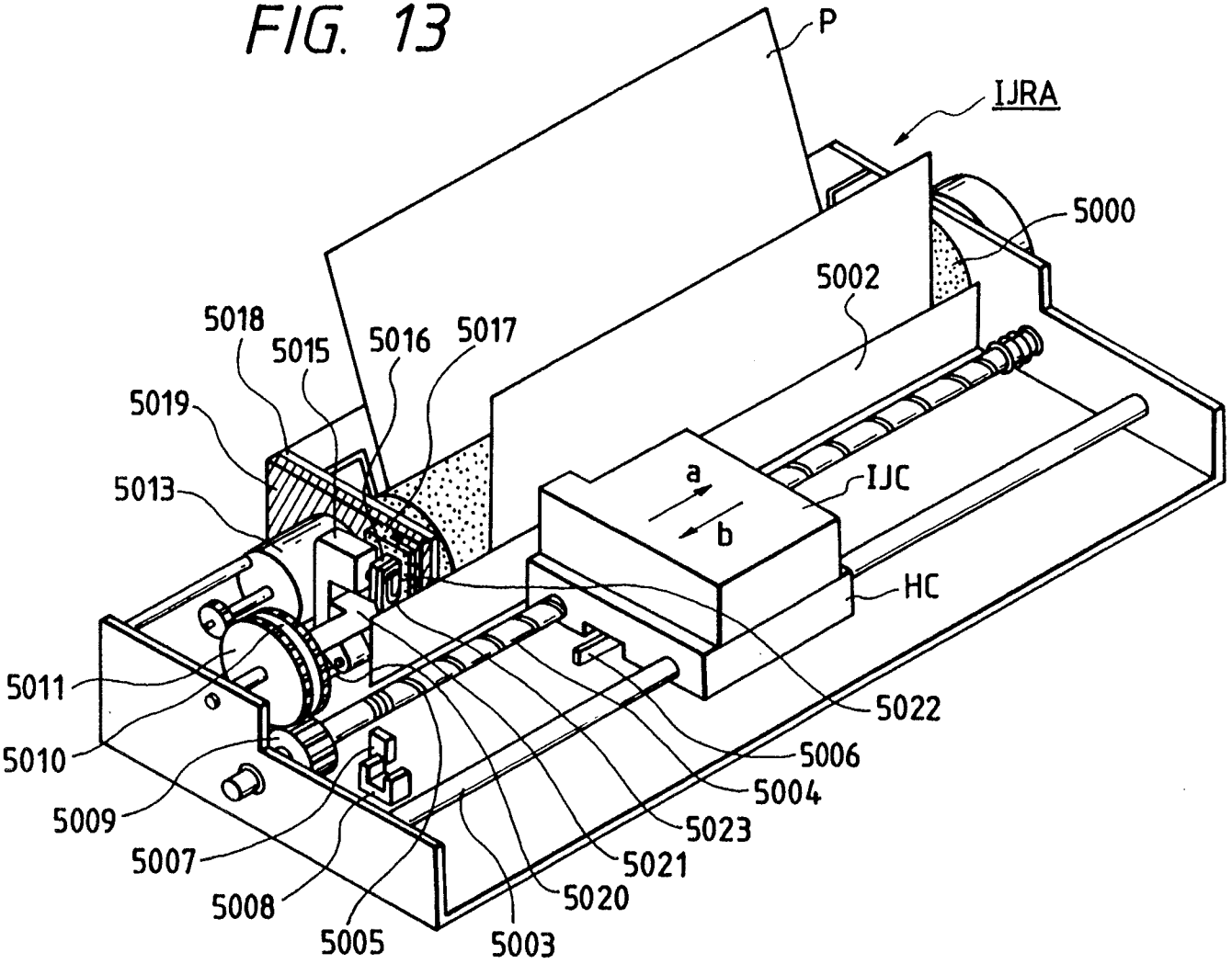
FIG. 13 is a schematic perspective view which illustrates an example of a recording apparatus according to the present invention.

FIG. 13 illustrates the appearance of an embodiment of the ink jet recording apparatus IJRA. A carriage HC has a pin (omitted from illustration), the carriage HC being engaged to a spiral groove 5004 formed in a lead screw 5005 which is rotated in synchronization with the forward/rearward rotation of a drive motor 5013 via drive force transmitting gears 5011 and 5009 so that it is reciprocated in directions respectively designated by arrows a and b. Reference numeral 5002 represents a paper holding plate for pressing paper to the platen 5000 in a direction in which the carriage HC move. Reference numerals 5007 and 5008 represent photocouplers each of which is a home position detection means for confirming the presence of a lever 5006 of the carriage HC in the above-described region to switch the rotational direction of a motor 5013 or the like. Reference numeral 5016 represents a member for supporting a cap member 5022 which caps the front surface of a recording head. Reference numeral 5015 represents a sucking member for sucking the recording head in the above-described cap, the sucking member performing sucking and recovering the recording head via an opening 5023 in the cap. Reference numeral 5017 represents a cleaning blade and 5019 represents a member for enabling the above-described blade 5017 to move in the longitudinal direction. The above-described members are supported by a body supporting plate 5018. A known cleaning blade may, of course, be applied to this embodiment. Reference numeral 5012 represents a lever for commencing sucking for recovering the recording head, the lever 5012 being moved when a cam 5020 which is engaged to the carriage HC is moved. Drive force supplied from a drive motor is transmitted from a known transmitting means such as a clutch.

The above-described capping operation, the cleaning operation and sucking operation for recovering the recording head are arranged to be performed at corresponding positions by an action of the lead screw 5005 when the carriage HC has been brought into the home position region. However, all of the above-described operations can be applied to this embodiment by arranging the structure in such a manner that a desired operation is performed at a known timing. Each of the above-described structures is an excellent invention if it is employed solely or combined to each other so that an excellent effect can be obtained when it is employed in this embodiment.

Furthermore, the apparatus according to this embodiment has a control portion for transmitting a drive signal for driving the recording head mounted.

Figure 14:
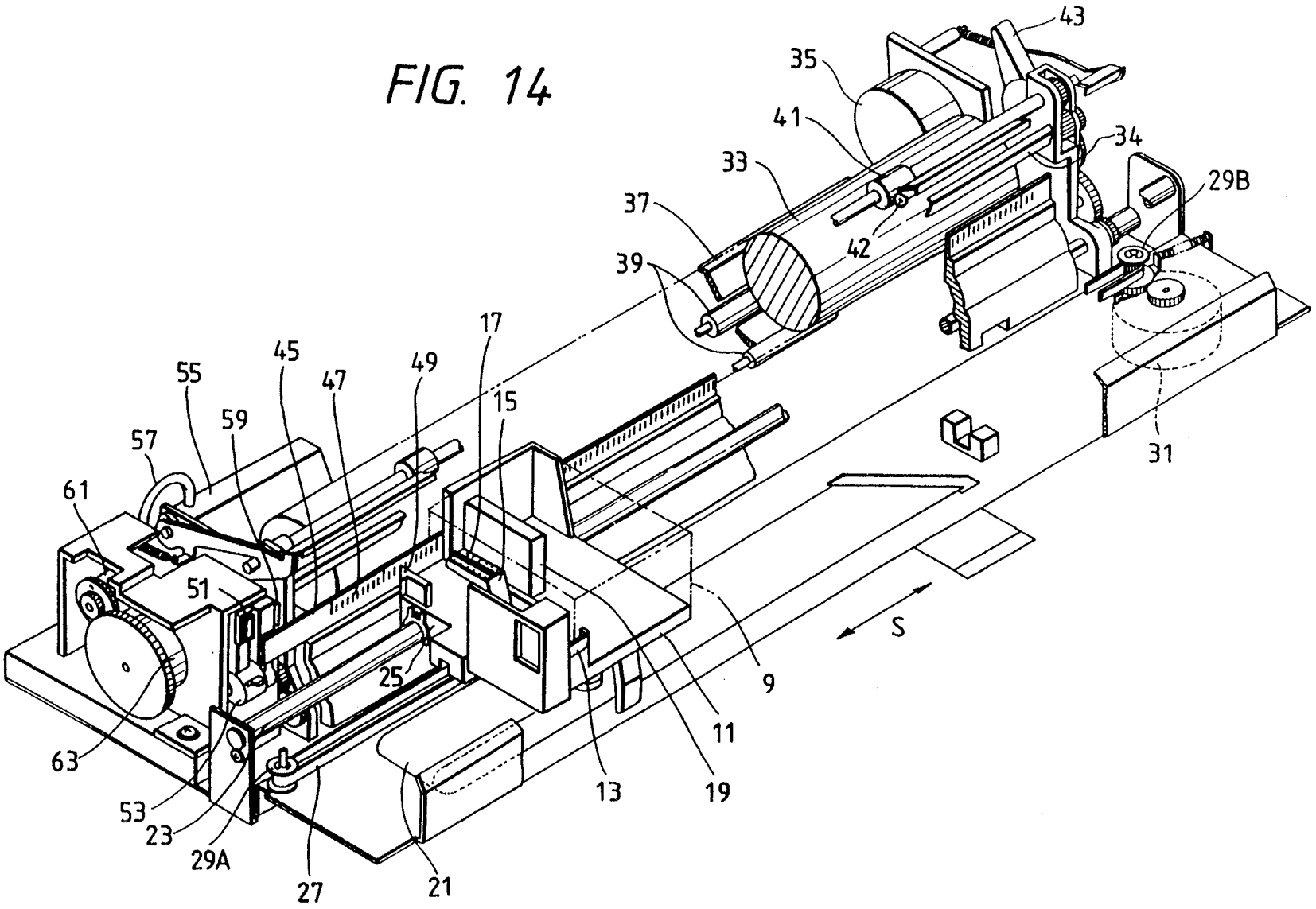
FIG. 14 is a schematic perspective view which illustrates another example of a recording apparatus according to the present invention.
Figure 15:
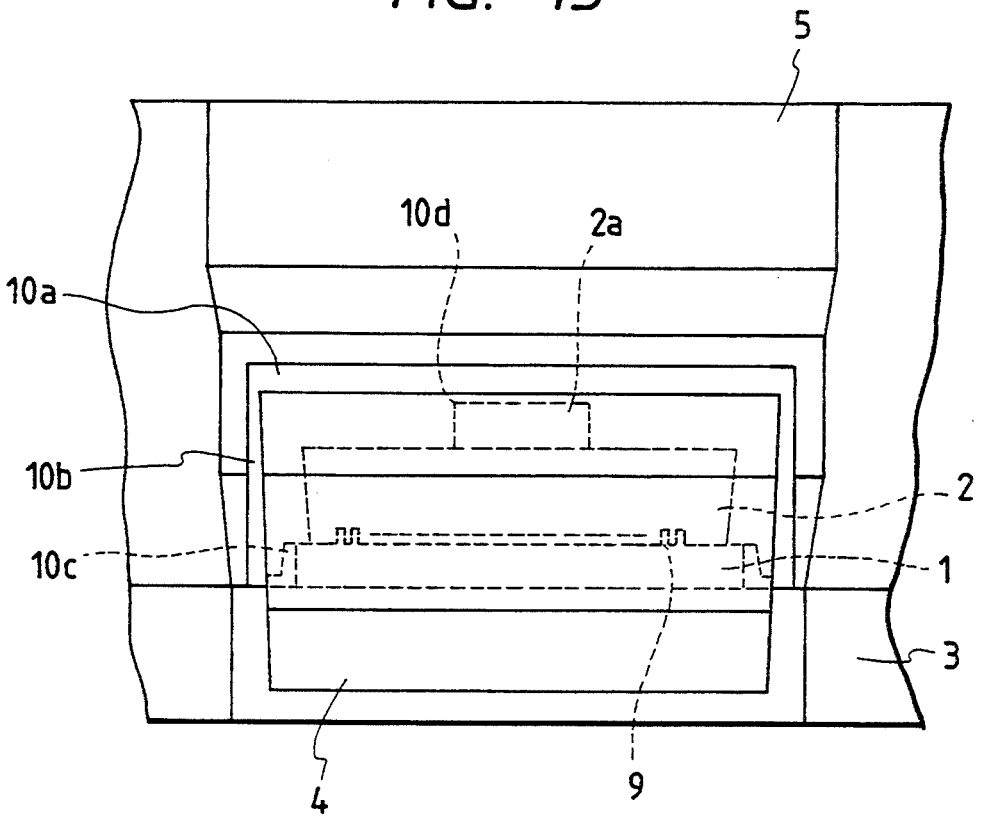
FIG. 15 is a schematic front elevational view which illustrates an example of a conventional ink jet head.

FIG. 14 is a perspective view which illustrates an example of the structure of a printer which is able to use the head cartridge according to the above-described embodiments of the present invention.

Reference numeral 9 represents a head cartridge which is able to comprise the ink jet head unit according to the present invention. Reference numeral 11 represents a carriage on which the head cartridge 9 is mounted and which performs scanning operation in direction designated by symbol S shown in FIG. 14. Reference numeral 13 represents a hook for fastening the head cartridge 9 to the carriage 11. Reference numeral 15 represents a lever for operating the hook 13. The lever 15 has a marker 17 for indicating a scale provided for a cover to be described later so that the printing position performed by the recording head or the setting position and the like are read. Reference numeral 19 represents a supporting plate for supporting an electrical connecting portion to be connected to the head cartridge 9. Reference numeral 21 represents a flexible cable for establishing a connection between the above-described electric connecting portion and the body control portion. A drive signal transmitted from the control portion disposed in the apparatus body is supplied to the recording head according to the present invention via the above-described flexible cable so that the recording head is driven.

Reference numeral 23 represents a guide shaft for guiding the carriage in the direction S, the guide shaft 23 being inserted into a bearing 25 of the carriage 11. Reference numeral 27 represents a timing belt to which the carriage 11 is secured and which transmits power to move the carriage 11 in the direction S. The timing belt 27 is arranged between pulleys 29A and 29B disposed on the two side portions of the apparatus. The pulley 29B is given drive force from a carriage motor 31 via a power conducting mechanism such as a gear.

Reference numeral 33 represents a conveyance roller for controlling the recording side of a recording medium (hereinafter also called "recording sheet") and as well as conveying the recording medium at the time of the recording operation or the like. The conveyance roller 33 is driven by a conveyance motor 35. Reference numeral 37 represents a paper tray for introducing the recording medium from a paper-supply tray 4 to the recording position. Reference numeral 39 represents a feed roller disposed in a paper feeding passage and for pressing the recording medium to the conveyance roller 33 for the purpose of conveying the recording medium. Reference numeral 34 represents a platen disposed to confront the discharge port formed in the cartridge 9 to control the recording side of the recording medium. Reference numeral 41 represents a paper discharging roller disposed at a position in the lower stream from the recording position on the passage through which the recording medium is conveyed, the discharging roller 41 acting to discharge the recording medium to the discharge port (omitted from illustration). Reference numeral 42 represents a spur disposed to correspond to the paper discharging roller 41, the spur 42 pressing the roller 41 via the recording medium so that the paper discharge roller 41 generates force for conveying the recording medium. Reference numeral 43 represents a release lever for releasing the urging force generated by the feed roller 39, the retaining plate 45 and the spur 42 at the time of setting of the recording medium.

Reference numeral 45 represents a retaining plate for restricting floating of the recording medium at a position in the vicinity of the recording position so as to realize a state in which the recording medium comes in contact with the conveyance roller 33 in a hermetical manner. According to this embodiment, an ink jet recording head of a type which discharges ink is employed as the recording head. Therefore, it is effective to dispose the retaining plate 45 because the distance between the surface of the recording head in which the ink discharge port is formed and the recording surface is small and the same must be strictly controlled for the purpose of preventing the contact between the recording medium and the surface in which the discharge port is formed. Reference numeral 47 represents a scale provided on the retaining plate 45.

Reference numeral 49 represents a marker provided on the carriage 11 to correspond to the above-described scale 47. The printing position and the setting position of the recording head can also be read by the above-described elements.

Reference numeral 51 represents a cap disposed to correspond to the surface of the recording head in which the ink discharge port is formed at the home position and made of elastic material such as rubber. The cap 51 is supported in such a manner that it is able to come in contact/move away from the recording head. The above-described cap 51 acts to protect the recording head when no recording is performed or when an operation of recovering the discharging operation of the recording head is effected. The "discharging operation recovering operation" includes an action arranged in such a manner that the cap 51 is made to confront the surface in which the discharge port is formed to drive an energy generating element disposed inside of the ink discharge port so as to generate energy for discharging ink. As a result, ink is discharge from the discharge port so that ink which cannot be used to perform recording due to bubble, dust and viscosity raised excessively and the like is discharged (previous discharge for removing a defective factor). Furthermore, ink is forcibly discharged from the discharge port while making the cap 5 cover the surface in which the discharge port is formed to remove the defective factor.

Reference numeral 53 represents a pump for generating suction force for forcibly discharging ink and sucking ink received in the cap 51 at the time of the discharge recovery operation by the forcible discharge or the discharge recovery operation by the previous discharge. Reference numeral 55 represents a waste ink tank for accumulating waste ink sucked by the pump 53 and 57 represents a tube for establishing a communication between the pump 53 and the waste ink tank 55.

Reference numeral 59 represents a blade for wiping the surface of the recording head in which the discharge port is formed, the blade 59 being supported in such a manner that it can be moved between a position at which wiping is performed during the movement of the head while projecting toward the recording head and a retracted position at which it is not engaged to the surface in which the discharge port is formed. Reference numeral 61 represents a motor and 63 represents a cam unit which receives power supplied from the motor 61 and which drives the pump 53 and moves the cap 51 and the blade 59.

The ink jet head cartridge to be mounted on the recording apparatus according to this embodiment may be arranged in such manner that the ink tank and the ink jet head unit are integrally formed or they are able to separate from each other.

The present invention brings about excellent effects particularly in a recording head or recording device of ink jet system utilizing heat energy among the ink jet recording systems.

As to its representative constitution and principle, for example, one practiced by use of the basic principle disclosed in, for example, U.S. Pat. Nos. 4,723,129 and 4,740,796 is preferred. This system is applicable to either of the so called on-demand type and the continuous type. Particularly, the case of the on-demand type is effective because, by applying at least one driving signal which gives rapid temperature elevation exceeding nucleate boiling corresponding to the recording information on electricity-heat converters arranged corresponding to the sheets or liquid channels holding liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequetely to accomplish more preferable discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination constitutions of discharging orifice, liquid channel, electricity-heat converter (linear liquid channel or right angle liquid channel) as disclosed in the above-mentioned respective specifications, the constitution by use of U.S. Pat. Nos. 4,558,333 and 4,459,600 disclosing the constitution having the heat acting portion arranged in the flexed region is also included in the present invention. In addition, the present invention can be also effectively made the constitution as disclosed in Japanese Patent Laid-Open Application No. 59-123670 which discloses the constitution using a slit common to a plurality of electricity-heat converters as the discharging portion of the electricity-heat converter or Japanese Patent Laid-Open Application No. 59-138461 which discloses the constitution having the opening for absorbing pressure waves of heat energy correspondent to the discharging portion.

Further, as the recording head of the full line type having a length corresponding to the maximum width of recording medium which can be recorded by the recording device, either the constitution which satisfies its length by combination of a plurality of recording heads as disclosed in the above-mentioned specifications or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device, or for the case by use of a recording head of the carriage type provided integrally on the recording head itself.

Also, addition of a restoration means for the recording head, a preliminary auxiliary means, etc. provided as the constitution of the recording device of the present invention is prefereable, because the effect of the present invention can be further stabilized. Specific examples of these may include, for the recording head, capping means, cleaning means, pressurization or aspiration means, electricity-heat converters or another heating element or preliminary heating means according to a combination of these, and it is also effective for performing stable recording to perform preliminary mode which performs discharging separate from recording.

Further, as the recording mode of the recording device, the present invention is extremely effective for not only the recording mode only of a primary color such as black etc., but also a device equipped with at least one of plural different colors or full color by color mixing, whether the recording head may be either integrally constituted or combined in plural number.

Furthermore, the form of ink jet recording apparatus according to the invention, in addition to what is used as image output terminal of a data processing apparatus such as computers, may be those of a copying apparatus combined with readers or facsimile apparatus having transmitting and receiving functions.

According to the above-described structure, a projection which is brought into contact with, for example, the connecting portion adjacent to the recording head is formed by utilizing, for example, a burr or the like formed at the time of the resin molding. Therefore, the recording head and the ink supply passage member can be brought into contact in a hermetical manner while absorbing the relative dimensional difference.

According to the present invention, as the sealer for sealing a space from a member for covering the connecting means for establishing the connection between the IJH and the circuit portion and as well as covering the portion in the vicinity of the IJH and the fastening portion, the material the air permeability of which is about 1/10 or less of the silicon resin which is employed in the conventional structure is employed. Therefore, the discharge operation can be normally performed because undesirable air introduction into the IJH can be satisfactorily prevented even if the ink jet unit is allowed to stand for a long time.

Furthermore, since the material displaying a low air permeability and a low steam permeability is used as the sealer, undesirable air introduction into the head and evaporation of the solvent of the ink can be prevented. Furthermore, since the material having urethane bonds in its molecules is used as the sealer, the oxygen, nitrogen and steam permeability can be reduced. Therefore, the undesirable introduction of bubbles into the recording head can be satisfactorily prevented even if the ink jet unit is allowed to stand for a relatively long time. Therefore, the discharge of light droplets can be performed normally while eliminating a necessity of performing the recovery operation such as the operation of sucking ink. As described above, the required number of the recovery operations can be reduced as described above. Therefore, the effective quantity of ink which can be used for the recording operation can be increased. That is, the running cost per printing medium can be reduced.

In addition, since the quantity of the waste ink can be reduced, the quantity and the volume of the absorbing member for absorbing the waste ink can significantly be reduced. Therefore, the cost of the waste-ink absorbing member can be reduced and as well as the overall size of the printer can be reduced.

The conventional IJH encounters a problem in that the normal discharge operation cannot be performed due to undesirable introduction of bubbles into the IJH if the same is allowed to stand for a predetermined time. Therefore, the conventional IJH must be arranged to act in accordance with a sequence arranged in such a manner that an automatic suction operation is performed at predetermined intervals by using a timer or the like. However, according to the present invention, a complicated sequence of the type described above can be omitted from the structure. Therefore, the body of the printer can be simplified and the overall cost of it can be reduced because the recovering sequence can be simplified and the necessity of using a battery for the timer can be eliminated.

In addition, according to the present invention, the sealer does not corrode the electrode and the wire bonding. Therefore, a reliable head can be provided.

Furthermore, since photosetting resin is used as a sealer for sealing a space from a member for covering the connecting means for establishing a connection between the IJH and the circuit board and surrounding a portion in the vicinity of the IJH and sealing the fastening portion, the reliability of the function of the sealer can be improved and the time which will be taken to assemble the elements can be shortened. Since the time which will be taken to manufacture the apparatus can be shortened as described above, an ink jet unit, an ink jet head and an ink jet recording apparatus the cost of which can be reduced can be provided.

As described above, according to the present invention, the ink jet head is arranged in such a manner that the gaps and the connecting portions between the ink supply member and the grooved ceiling plate and the heater board and the like and the gap between the orifice plate and the end surface of the supporting substrate can be sealed by a photosetting resin such as the ultraviolet hardening resin at room temperature and humidity in a short time. Therefore, since the employed ultraviolet hardening resin is a single liquid type resin, the necessities of performing a measuring operation and mixture operation can be eliminated and using the solvent can be eliminated. Therefore, the facility can be simplified and thereby it can be produced in a mass production manner. Therefore, the cost of the product which uses it can be reduced.

In addition, the gap or the like between the orifice plate portion and the ink supply member can uniformly performed in a short time. Furthermore, the sealing operation can be performed by a several times of operations. Therefore, another effect can be obtained in that labor can be reduced.

As a result, the gaps between the orifice plate and the heater board can stably be sealed. Therefore, power loss at the time of the discharge operation can be prevented and the discharge can be performed stably. Furthermore, a leakage of air through the gap between the orifice plate and the ink supply member can be prevented. As a result, the recovery operation can be performed smoothly. Consequently, an ink jet head exhibiting the above-described advantages can stably and efficiently manufactured.

Although the invention has been described in its preferred form with a certain degree of particularity it is understood that the present disclosure of the preferred form has been changed in the details of construction and the combination and arrangement of parts may be resorted to without departing from the spirit and the scope of the invention as hereinafter claimed.

What is claimed is:

1. An ink jet recording head unit for performing a recording operation by discharging ink, the ink jet recording head unit comprising:

an ink jet head portion having an ink passage communicated with a discharge port for discharging ink and a substrate having an energy generating element for causing energy for discharging ink to act on ink present in said ink passage and supplied through an ink receiving port of a connecting portion; and an ink supply member having a connecting portion to be connected to said ink jet head portion so as to supply ink to said ink jet head portion via said connecting portion, wherein at least one of said connecting portion of said ink jet head portion and said connecting portion of said ink supply member has a projection portion at a position at which it comes in contact with a corresponding connection port so that said at least one connecting portion is connected to a corresponding connecting portion by deforming and bringing said projection portion into contact with said connecting portions.

2. An ink jet head unit according to claim 1, wherein said projection portion is formed integrally at least one connecting portion.

3. An ink jet head unit according to claim 2, wherein said connecting portion having said projection portion is made of a resin.

4. An ink jet head unit according to claim 1, wherein said connecting portions are sealed by a sealer.

5. An ink jet head unit according to claim 4, wherein said sealer is comprised of a material having a urethane bond in the molecule.

6. An ink jet head unit according to claim 4, wherein said sealer is made of material the air permeability of which is $40\times10^{-10}$ [cm$^3$][cm]/[sec][cm$^2$][cmHg] or less.

7. An ink jet head unit according to claim 4, wherein said sealer is made of material the steam permeability of which is $5\times10^{-7}$ [cm$^3$][cm]/[sec][cm$^2$][cmHg] or less.

8. An ink jet recording head unit according to claim 4, wherein an impurities ion density of the sealer is equal to or less than 30 ppm.

9. An ink jet head unit according to claim 1, wherein said energy generating element comprises an electrothermal converting member for generating thermal energy to discharge ink by generating bubbles by said thermal energy.

10. An ink jet recording head unit according to claim 1, wherein the projection portion is provided at the connecting portion of the ink jet head portion.

11. An ink jet recording head unit according to claim 1, wherein the projection portion is provided at the connecting portion of the ink supply member.

12. An ink jet recording head unit according to claim 1, wherein a deforming force for the projection portion is 100–300 g.

13. An ink jet head cartridge unit for performing a recording operation by discharging ink, the ink jet head cartridge unit comprising:

an ink jet head portion having an ink passage communicated with a discharge port for discharging ink and a substrate having an energy generating element for causing energy for discharging ink to act on ink present in said ink passage and supplied through an ink receiving port of a connecting portion;

an ink supply member having a connecting portion to be connected to said ink jet head portion so as to supply ink to said ink jet head portion via said connecting portion;

wherein an ink jet head unit is formed in such a manner that at least one of said connecting portion of said ink jet head portion and said connecting portion of said ink supply member has a projection portion at a position at which it comes in contact with a corresponding connection port so that said at least one connecting portion is connected to a corresponding connecting portion by deforming and bringing said projection portion into contact with said connecting portions; and an ink tank for supplying ink to said ink jet unit.

14. An ink jet head cartridge unit according to claim 13, wherein said projection portion is formed integrally with said at least one connecting portion.

15. An ink jet head cartridge unit according to claim 13, wherein said connecting portion having said projection portion is made of a resin.

16. An ink jet head cartridge unit according to claim 13, wherein said connecting portions are sealed by a sealer.

17. An ink jet head cartridge unit according to claim 13, wherein said energy generating element comprises an electro-thermal converting member for generating thermal energy to discharge ink by generating bubbles by said thermal energy.

18. An ink jet head cartridge unit according to claim 13, wherein said sealer is made of a material having a urethane bond in the molecule.

19. An ink jet head cartridge unit according to claim 13, wherein said sealer is made of material the air permeability of which is $40\times10^{-10}$ [$cm^3$][cm]/[sec][$cm^2$][cmHg] or less.

20. An ink jet head cartridge unit according to claim 13, wherein said sealer is made of material the steam permeability of which is $5\times10^{-7}$ [$cm^3$][cm]/[sec][$cm^2$][cmHg] or less.

21. An ink jet recording apparatus for performing a recording operation by discharging ink, said ink jet recording apparatus comprising:

an ink jet recording unit including an ink jet head portion having an ink passage communicated with a discharge port for discharging ink and a substrate having an energy generating element for causing energy for discharging ink to act on ink present in said ink passage and supplied through an ink receiving port of a connecting portion, and an ink supply member having a connecting portion to be connected to said ink jet head portion so as to supply ink to said ink jet head portion via said connecting portion, wherein at least one of said connecting portion of said ink jet head portion and said connecting portion of said ink supply member has a projection portion at a position at which it comes in contact with a corresponding connection port so that said at least one connecting portion is connected to a corresponding connecting portion by deforming and bringing said projection portion into contact with said connecting portions; and a control portion for supplying a drive signal for driving said ink jet head unit.

22. An ink jet recording apparatus according to claim 21, wherein the projection portion is provided at the connecting portion of the ink jet head portion.

23. An ink jet recording apparatus according to claim 21, wherein the projection portion is provided at the connecting portion of the ink supply member.

24. An ink jet recording apparatus according to claim 21, wherein a deforming force for the projection portion is 100–300 g.

25. An ink jet recording apparatus according to claim 21, further comprising conveying means for conveying a recording medium.

26. An ink jet recording head unit for performing a recording operation by discharging ink, the ink jet head unit comprising:

an ink jet head portion having an ink passage communicated with a discharge port for discharging ink and a substrate having an energy generating element for causing energy for discharging ink to act on ink present in said ink passage and supplied through an ink receiving portion of a connecting portion; and an ink supply member having a connection portion to be connected to said ink jet head portion so as to supply ink to said ink jet head portion via said connecting portion, wherein at least a connection section between said connection portions of said ink jet head portion and said ink supply member are sealed by a sealer made of material the air permeability of which is $40\times10^{-10}$ [$cm^3$][cm]/[sec][$cm^2$][cmHg] or less.

27. An ink jet head unit according to claim 26, wherein said energy generating element comprises an electro-thermal converting member for generating thermal energy to discharge ink by generating bubbles by said thermal energy.

28. An ink jet head unit according to claim 26, wherein said sealer is made of a material having a urethane bond in the molecule.

29. An ink jet head unit according to claim 26, wherein said sealer contains impurities in a density of 30 ppm or less.

30. An ink jet head unit according to claim 26, wherein said ink jet head portion is comprised of a first substrate being said substrate having said energy generating element, a second substrate having a wall connected to said first substrate and constituting said ink passage and an urging member for applying an urging force to said first and second substrates to bring said first and second substrates into contact with each other.

31. An ink jet recording head unit for performing a recording operation by discharging ink, the ink jet head unit comprising:

an ink jet head portion having an ink passage communicated with a discharge port for discharging ink and a substrate having an energy generating element for causing energy for discharging ink to act on ink present in said ink passage and supplied through an ink receiving portion of a connecting portion; and an ink supply member having a connection portion to be connected to said ink jet head portion so as to supply ink to said ink jet head portion via said connecting portion, wherein at least a connection section between said connection portions of said ink jet head portion and said ink supply member are sealed by a sealer made of material the steam permeability of which is $5\times10^{-7}$ [cm$^3$][cm]/[sec][cm$^2$][cmHg] or less.

32. An ink jet head unit according to claim 31, wherein said energy generating element comprises an electro-thermal converting member for generating thermal energy to discharge ink by generating bubbles by said thermal energy.

33. An ink jet head unit according to claim 31, wherein said sealer is made of a material having a urethane bond in the molecule.

34. An ink jet head unit according to claim 31, wherein said ink jet head portion is comprised of a first substrate being said substrate having said energy generating element, a second substrate having a wall connected to said first substrate and constituting said ink passage and an urging member for applying an urging force to said first and second substrates to bring said first and second substrates into contact with each other.

35. An ink jet head unit according to claim 31, wherein said sealer contains impurities in a density of 30 ppm or less.

36. An ink jet recording head unit according to claim 4, 26 or 31, wherein the viscosity of the sealer is 1000–15000 cps.

37. An ink jet recording head unit according to claim 4, 26 or 31, wherein the sealer is formed of one of urethane resin, acryl resin, flexible epoxy resin and rubber adhesive.

38. An ink jet recording head unit for performing a recording operation by discharging ink, the ink jet head unit comprising:

an ink jet head portion having an ink passage communicated with a discharge port for discharging ink and a substrate having an energy generating element for causing energy for discharging ink to act on ink present in said ink passage and supplied through an ink receiving portion of a connecting portion; and an ink supply member having a connection portion to be connected to said ink jet head portion so as to supply ink to said ink jet head portion via said connecting portion, wherein at least a connection section between said connection portions of said ink jet head portion and said ink supply member are sealed by a photosetting resin.

39. An ink jet head unit according to claim 38, wherein said ink jet head portion is comprised of a first substrate being said substrate having said energy generating element, a second substrate having a wall connected to said first substrate and constituting said ink passage and an urging member for applying an urging force to said first and second substrates to bring said first and second substrates into contact with each other.

40. An ink jet recording head unit according to claim 26, 31 or 38, further comprising an orifice plate, wherein a gap between the orifice plate and the ink supply member is sealed.

41. An ink jet recording head unit according to claim 26, 31 or 38, wherein the ink jet head portion includes a wire bonding portion and the wire bonding portion is sealed.

42. An ink jet recording head unit according to claim 26, 31 or 38, wherein the ink jet head portion includes a wire bonding plate and an orifice plate and a gap between the wire bonding plate and the orifice plate, and the ink supply member and a gap between the orifice plate and an end of the substrate are sealed.

43. An ink jet head cartridge unit for performing a recording operation by discharging ink, the ink jet head cartridge unit comprising:

an ink jet head portion having an ink passage communicated with a discharge port for discharging ink and a substrate having an energy generating element for causing energy for discharging ink to act on ink present in said ink passage and supplied through an ink receiving port of a connecting portion;

an ink supply member having a connecting portion to be connected to said ink jet head portion so as to supply ink to said ink jet head portion via said connecting portion;

wherein an ink jet head unit is formed in such a manner that at least one of said connecting portion of said ink jet head portion and said connecting portion of said ink supply member has a projection portion at a position at which it comes in contact with a corresponding connection port so that said at least one connecting portion is connected to a corresponding connecting portion by deforming and bringing said projection portion into contact with said connecting portions; and an ink tank removably mountable on the ink jet unit to supply ink to said ink jet unit.

44. An ink jet head cartridge unit according to claim 13 or 43, wherein the projection portion is provided at the connecting portion of the ink jet head portion.

45. An ink jet head cartridge unit according to claim 13 or 43, wherein the projection portion is provided at the connecting portion of the ink supply member.

46. An ink jet head cartridge unit according to claim 13 or 43, wherein a deforming force for the projection portion is 100–300 g.

47. An ink jet head cartridge unit for performing a recording operation by discharging ink, the ink jet head cartridge unit comprising:

an ink jet head portion having an ink passage communicated with a discharge port for discharging ink and a substrate having an energy generating element for causing energy for discharging ink to act on ink present in said ink passage and supplied through an ink receiving portion of a connecting portion;

an ink supply member having a connection portion to be connected to said ink jet head portion so as to supply ink to said ink jet head portion via said connecting portion, wherein an ink jet head unit is formed such that at least a connection section between said connection portions of said ink jet head portion and said ink supply member are sealed by a sealer made of material the air permeability of which is $40\times10^{-10}$ [cm$^3$] [cm]/[sec][cm$^2$][cmHg] or less; and an ink tank removably mountable on the ink jet head unit to supply ink to the ink jet head unit.

48. An ink jet head cartridge unit according to claim 47, wherein said energy generating element comprises an electro-thermal converting member for generating thermal energy to discharge ink by generating bubbles by said thermal energy.

49. An ink jet head cartridge unit according to claim 47, wherein said sealer is made of a material having a urethane bond in the molecule.

50. An ink jet head cartridge unit according to claim 47, wherein said sealer contains impurities in a density of 30 ppm or less.

51. An ink jet head cartridge unit for performing a recording operation by discharging ink, the ink jet head cartridge unit comprising:

an ink jet head portion having an ink passage communicated with a discharge port for discharging ink and a substrate having an energy generating element for causing energy for discharging ink to act on ink present in said ink passage and supplied through an ink receiving portion of a connecting portion;

an ink supply member having a connection portion to be connected to said ink jet head portion so as to supply ink to said ink jet head portion via said connecting portion, wherein an ink jet head unit is formed such that at least a connection section between said connection portions of said ink jet head portion and said ink supply member are sealed by a sealer made of material the steam permeability of which is $5\times10^{-7}$ [cm$^3$][cm]/[sec][cm$^2$][cmHg] or less; and an ink tank removably mountable on the ink jet head unit to supply ink to the ink jet head unit.

52. An ink jet head cartridge unit according to claim 51, wherein said energy generating element comprises an electro-thermal converting member for generating thermal energy to discharge ink by generating bubbles by said thermal energy.

53. An ink jet head cartridge unit according to claim 51, wherein said sealer is made of a material having a urethane bond in the molecule.

54. An ink jet head cartridge unit according to claim 51, wherein said sealer contains impurities in a density of 30 ppm or less.

55. An ink jet head cartridge unit for performing a recording operation by discharging ink, the ink jet head cartridge unit comprising:

an ink jet head portion having an ink passage communicated with a discharge port for discharging ink and a substrate having an energy generating element for causing energy for discharging ink to act on ink present in said ink passage and supplied through an ink receiving portion of a connecting portion;

an ink supply member having a connection portion to be connected to said ink jet head portion so as to supply ink to said ink jet head portion via said connecting portion, wherein an ink jet head unit is formed such that at least a connection section between said connection portions of said ink jet head portion and said ink supply member are sealed by a photosetting resin; and an ink tank removably mountable on the ink jet head unit to supply ink to the ink jet head unit.

56. An ink jet head cartridge unit according to claim 53, wherein said energy generating element comprises an electro-thermal converting member for generating thermal energy to discharge ink by generating bubbles by said thermal energy.

57. An ink jet head cartridge unit according to claim 55, wherein said sealer is made of a material having a urethane bond in the molecule.

58. An ink jet head cartridge unit according to claim 55, wherein said sealer contains impurities in a density of 30 ppm or less.

59. An ink jet head cartridge unit according to claim 16, 47, 51 or 55, wherein the viscosity of the sealer is 1000–15000 cps.

60. An ink jet head cartridge unit according to claim 16, 47, 51 or 55, wherein an impurities ion density of the sealer is equal to or less than 30 ppm.

61. An ink jet head cartridge unit according to claim 16, 43, 47, 51 or 55, wherein the sealer is formed of one of urethane resin, acryl resin, flexible epoxy resin and rubber adhesive.

62. An ink jet head cartridge unit according to claim 47, 51 or 55, further comprising an orifice plate, wherein a gap between the orifice plate and the ink supply member is sealed.

63. An ink jet head cartridge unit according to claim 47, 51 or 55, wherein the ink jet head portion includes a wire bonding portion and the wire bonding portion is sealed.

64. An ink jet head cartridge unit according to claim 47, 51 or 55, wherein the ink jet head portion includes a wire bonding plate and an orifice plate and a gap between the wire bonding plate and the orifice plate, and the ink supply member and a gap between the orifice plate and an end of the substrate are sealed.

65. An ink jet head cartridge unit according to claim 13, 47, 51 or 55, wherein the ink tank is removably mountable on the ink jet head cartridge.

66. An ink jet recording apparatus for performing a recording operation by discharging ink, said ink jet recording apparatus comprising:

an ink jet head unit including an ink jet head portion having an ink passage communicated with a discharge port for discharging ink and a substrate having an energy generating element for causing energy for discharging ink to act on ink present in said ink passage and supplied through an ink receiving portion of a connecting portion, and an ink supply member having a connection portion to be connected to said ink jet head portion so as to supply ink to said ink jet head portion via said connecting portion, wherein at least a connection section between said connection portions of said ink jet head portion and said ink supply member are sealed by a sealer made of material the air permeability of which is $40\times10^{-10}$ [cm$^3$][cm]/[sec][cm$^2$][cmHg] or less; and a control portion for supplying a drive signal for driving said ink jet head unit.

67. An ink jet recording apparatus for performing a recording operation by discharging ink, said ink jet recording apparatus comprising:

an ink jet head unit including an ink jet head portion having an ink passage communicated with a discharge port for discharging ink and a substrate having an energy generating element for causing energy for discharging ink to act on ink present in said ink passage and supplied through an ink receiving portion of a connecting portion, and an ink supply member having a connection portion to be connected to said ink jet head portion so as to supply ink to said ink jet head portion via said connecting portion, wherein at least a connection section between said connection portions of said ink jet head portion and said ink supply member are sealed by a sealer made of material the steam permeability of which is $5\times10^{-7}$ [cm$^3$][cm]/[sec][cm$^2$][cmHg] or less; and a control portion for supplying a drive signal for driving said ink jet head unit.

68. An ink jet recording apparatus for performing a recording operation by discharging ink, the ink jet recording apparatus comprising:

an ink jet head unit including an ink jet head portion having an ink passage communicated with a discharge port for discharging ink and a substrate having an energy generating element for causing energy for discharging ink to act on ink present in said ink passage and supplied through an ink receiving portion of a connecting portion, and an ink supply member having a connection portion to be connected to said ink jet head portion so as to supply ink to said ink jet head portion via said connecting portion, wherein at least a connection section between said connection portions of said ink jet head portion and said ink supply member are sealed by a photosetting resin; and a control portion for supplying a drive signal for driving said ink jet head unit.

69. An ink jet according apparatus according to claim 21, 66, 67 or 68, wherein the ink jet head unit is removably mountable on the ink jet recording apparatus.

* * * * *

UNITED STATES PATENT AND TRADEMARK OFFICE

CERTIFICATE OF CORRECTION

PATENT NO. : 5,450,110

DATED : September 12, 1995

INVENTOR(S) : Osamu Sato, et al.

It is certified that error appears in the above-identified patent and that said Letters Patent is hereby corrected as shown below:

On the title page: Item

[56] REFERENCES CITED

Foreign Priority Documents, "2204044 8/1990 Japan 3169557 7/1991 Japan" should read --2-204044 8/1990 Japan, 3-169557 7/1991 Japan--

COLUMN [57] ABSTRACT

Line 3, "desclosed" should read --disclosed--.

COLUMN 3

Line 51, "it" should read --it as--
Line 54, "can" should read --can be--.

COLUMN 5

Line 24, "take" should read --taken--.

COLUMN 7

Line 50, "to" should be deleted.

UNITED STATES PATENT AND TRADEMARK OFFICE

CERTIFICATE OF CORRECTION

PATENT NO. : 5,450,110

DATED : September 12, 1995

INVENTOR(S) : Osamu Sato, et al.

It is certified that error appears in the above-identified patent and that said Letters Patent is hereby corrected as shown below:

COLUMN 8

Line 4, "to" should be deleted
Line 6, "be" should be deleted.

COLUMN 13

Line 39, "stabled" should read --stabilized.--.

COLUMN 14

Line 61, "IT." should read --IT engages.--
Line 62, "engages" should be deleted.

COLUMN 15

Line 52, "as" (second occurrence) should be deleted.

COLUMN 17

Line 31, "foam" should read --form--.

COLUMN 21

Line 67, "lysinediisocyanate" should be deleted.

COLUMN 23

Line 59, "resuled" should read --resulted in--.

UNITED STATES PATENT AND TRADEMARK OFFICE

CERTIFICATE OF CORRECTION

PATENT NO. : 5,450,110

DATED : September 12, 1995

INVENTOR(S) : Osamu Sato, et al.

It is certified that error appears in the above-identified patent and that said Letters Patent is hereby corrected as shown below:

COLUMN 24

Line 14, "Butadine" should read --Butadiene--.

COLUMN 25

Line 13, "pre-premerization" should read --pre-polymerization--
Line 28, "alkidaclylate" should read --alkidacrylate,--
Line 50, "acrylc" should read --acrylic--.

COLUMN 26

Line 27, "move" should read --moves.--.

COLUMN 28

Line 13, close up right margin
Line 14, close up left margin
Line 29, "operation" should read --operation includes-- and "includes" should be deleted.

UNITED STATES PATENT AND TRADEMARK OFFICE

CERTIFICATE OF CORRECTION

PATENT NO. : 5,450,110

DATED : September 12, 1995

INVENTOR(S) : Osamu Sato, et al.

It is certified that error appears in the above-identified patent and that said Letters Patent is hereby corrected as shown below:

COLUMN 31

Line 50, "can" should read --can be--.

COLUMN 32

Line 29, "integrally" should read -- integrally with said--.

COLUMN 37

Line 55, "53," should read --55,--.

Signed and Sealed this

Thirteenth Day of February, 1996

Bruce Lehman

*Attest:*

BRUCE LEHMAN

*Attesting Officer*

*Commissioner of Patents and Trademarks*